US007131617B2

(12) United States Patent
Bontrager et al.

(10) Patent No.: US 7,131,617 B2
(45) Date of Patent: Nov. 7, 2006

(54) MODIFIED SPRING SYSTEM END CAP FOR PACKAGING FRAGILE ARTICLES WITHIN SHIPPING CARTONS

(75) Inventors: Richard L. Bontrager, Ripon, CA (US); Michael A. Brown, Jamestown, RI (US); Robert F. Hacker, McHenry, IL (US); Randall G. Strange, Lompoc, CA (US)

(73) Assignee: RSVP Operations, LLC, Campbell, CA (US)

( * ) Notice: Subject to any disclaimer, the term of this patent is extended or adjusted under 35 U.S.C. 154(b) by 0 days.

(21) Appl. No.: 10/717,110

(22) Filed: Nov. 19, 2003

(65) Prior Publication Data

US 2005/0103963 A1 May 19, 2005

(51) Int. Cl.
*A47B 95/00* (2006.01)

(52) U.S. Cl. ..... 248/345.1; 206/320; 206/453

(58) Field of Classification Search ..... 206/320, 206/453, 586, 587, 591, 592, 521.8, 521.9; 248/345.1

See application file for complete search history.

(56) References Cited

U.S. PATENT DOCUMENTS

| | | | | | |
|---|---|---|---|---|---|
| 2,769,534 | A | * | 11/1956 | Lidgard | 206/448 |
| 2,783,930 | A | | 3/1957 | Riley | 229/14 |
| 2,808,189 | A | | 10/1957 | Williams | 229/14 |
| 2,935,206 | A | | 5/1960 | Smith | 211/65 |
| 2,974,788 | A | | 3/1961 | Robbins | 206/65 |
| 2,994,466 | A | | 8/1961 | Thompson | 229/30 |
| 3,146,932 | A | | 9/1964 | Mayer | 229/14 |
| 3,176,743 | A | | 4/1965 | Bundy | 150/42 |
| 3,181,766 | A | | 5/1965 | Kane et al. | 229/14 |
| 3,192,978 | A | | 7/1965 | Horvath | 150/0.5 |
| 3,366,231 | A | | 1/1968 | Trakas | 206/65 |
| 3,437,423 | A | | 4/1969 | Mondiadis | 21/83 |
| 3,724,654 | A | | 4/1973 | Gerard et al. | 206/72 |
| 3,768,639 | A | | 10/1973 | Dogliotti | 206/45.19 |
| 3,835,986 | A | | 9/1974 | Le Beau | 206/320 |
| 4,006,818 | A | | 2/1977 | Wannyn | 206/564 |
| 4,132,311 | A | | 1/1979 | Glinert | 206/387 |
| 4,360,145 | A | | 11/1982 | Wilcox | 229/1.5 R |
| 4,398,212 | A | | 8/1983 | Serry et al. | 358/93 |
| 4,515,272 | A | | 5/1985 | Newhouse | |
| 4,645,079 | A | | 2/1987 | Hill | 206/563 |
| 4,671,407 | A | | 6/1987 | Brutosky | 206/332 |
| 4,705,170 | A | * | 11/1987 | Creaden | 206/419 |
| 4,709,808 | A | | 12/1987 | Balduff et al. | 206/158 |
| 4,823,956 | A | | 4/1989 | Belisle | 206/523 |

(Continued)

FOREIGN PATENT DOCUMENTS

| | | |
|---|---|---|
| DE | 3843990 | 7/1990 |

(Continued)

*Primary Examiner*—Korie Chan
(74) *Attorney, Agent, or Firm*—Fliesler Meyer LLP

(57) ABSTRACT

Structures for a unitary spring system end cap include at least one rib formed on the outer wall of an end cap. The at least one rib can protrude from the outer wall, for example centered along the length of a spring system. Where a carton containing a product protected by a unitary spring system end cap is dropped from a height, the rapid deceleration caused by an impact with a surface causes the at least one rib to engage the spring system on which it is centered. A second such structure includes at least one bulbous feature located centrally of the platform of an end cap. The at least one bulbous feature can absorb compressive forces applied to the platform of the end cap, crushing in a controlled manner.

5 Claims, 30 Drawing Sheets

U.S. PATENT DOCUMENTS

| | | | | | |
|---|---|---|---|---|---|
| 4,828,115 | A | * | 5/1989 | Wiegand et al. | 206/576 |
| 4,883,179 | A | | 11/1989 | Dionne | 206/523 |
| 4,936,453 | A | | 6/1990 | Knitter | 206/419 |
| 4,972,951 | A | | 11/1990 | Vartanian | 206/387 |
| 5,131,543 | A | | 7/1992 | Stephens | |
| 5,226,543 | A | | 7/1993 | Foos et al. | 206/592 |
| 5,249,685 | A | | 10/1993 | Stephens | |
| 5,368,159 | A | * | 11/1994 | Doria | 206/320 |
| 5,385,232 | A | | 1/1995 | Foos et al. | 206/320 |
| 5,445,292 | A | | 8/1995 | Slomski et al. | |
| 5,515,976 | A | | 5/1996 | Moren et al. | 206/586 |
| 5,545,370 | A | | 8/1996 | Moren et al. | 264/522 |
| 5,586,677 | A | | 12/1996 | Foos | |
| 5,628,402 | A | | 5/1997 | Dickie et al. | 206/521 |
| 5,634,559 | A | | 6/1997 | Foos et al. | |
| 5,755,331 | A | * | 5/1998 | Watson | 206/586 |
| 5,788,105 | A | | 8/1998 | Foos | |
| 5,799,796 | A | * | 9/1998 | Azelton et al. | 206/586 |
| 5,806,286 | A | * | 9/1998 | Oinuma et al. | 53/472 |
| 6,010,007 | A | | 1/2000 | Moren et al. | |
| 6,082,546 | A | * | 7/2000 | Liao et al. | 206/592 |
| 6,105,765 | A | * | 8/2000 | Chu | 206/320 |
| 6,123,199 | A | * | 9/2000 | Madsen | 206/586 |
| 6,123,200 | A | | 9/2000 | Stephens et al. | |
| 6,142,304 | A | | 11/2000 | Moren et al. | |
| 6,179,122 | B1 | * | 1/2001 | Moncrief et al. | 206/320 |
| RE37,253 | E | * | 7/2001 | Moren et al. | 206/586 |
| 6,405,873 | B1 | * | 6/2002 | Koike | 206/592 |
| 6,520,337 | B1 | * | 2/2003 | Smith | 206/592 |
| 6,622,860 | B1 | * | 9/2003 | Horbal | 206/320 |
| 6,786,334 | B1 | | 9/2004 | Smith | 206/592 |
| 6,889,839 | B1 | | 5/2005 | Rosten et al. | 206/583 |
| 6,976,587 | B1 | | 12/2005 | Liverman et al. | 206/586 |
| 2005/0115858 | A1 | | 6/2005 | Maresh et al. | |

FOREIGN PATENT DOCUMENTS

| | | | |
|---|---|---|---|
| EP | 0 313 066 A2 | | 4/1989 |
| GB | 1 224 493 | | 3/1971 |
| GB | 2 229 416 A | | 9/1990 |
| WO | WO 00/59804 | * | 10/2000 |

* cited by examiner

MODIFIED SPRING SYSTEM END CAP FOR PACKAGING FRAGILE ARTICLES WITHIN SHIPPING CARTONS

TECHNICAL FIELD

The present invention relates to packaging used for shipping articles, and more particularly to flexible plastic packaging units of unitary construction for supporting and protecting a shock or vibration sensitive article inside a shipping carton.

BACKGROUND

Shock and/or vibration sensitive articles, such as computers, monitors, TV's, VCR's, radios, computer tape and disk drives, and other sensitive electronic equipment, require special packaging when shipped inside shipping cartons. Conventional carton packaging used to protect such articles includes paper, nuggets of expanded foam, preformed polystyrene foam or beads, etc. Ideally, the packaging absorbs and dissipates shocks and vibrations impinging the shipping carton to minimize the shocks and vibrations experienced by the fragile article.

More recently, manufacturers of shock/vibration sensitive articles have developed stringent shock dissipation requirements for packaging used to ship their products. For example, some manufacturers use "drop test" requirements, which dictate the maximum amount of g-force that the article packaged inside a carton can experience when the carton is dropped from a certain height. The drop test requirements typically include several g force values, depending upon which carton side, edge, and/or corner lands on the drop surface. Therefore, the carton packaging needs to adequately dissipate shocks induced from many directions.

As shock dissipation requirements become more complex, so too must the carton packaging. The performance of the carton packaging design must not only satisfy the shock dissipation requirements, but ideally should also be easily adaptable to change the shock dissipation performance since shock dissipation requirements can change for any given article, or are different from article to article.

To complicate the problem of selecting appropriate carton packaging, many articles now require protection against vibration as well. Therefore, shipping carton packaging should not only absorb shock forces to meet the above mentioned drop test requirements, but must also sufficiently absorb vibrations typically experienced by shipping cartons in transit.

Conventional carton packaging materials have proved inadequate to meet the more stringent shock and vibration absorption requirements for modern articles of commerce. In order to satisfy such requirements, large volumes of conventional carton packaging is required around the article. Voluminous packaging materials are expensive and take up excessive warehouse space before use and trash/recycling space after use. Further, larger shipping cartons are necessitated by the voluminous carton packaging, which are more expensive to purchase and to ship. The shock/vibration dissipation performance of paper, nugget and bead packaging materials can depend in large part on how the user actually packages the particular article. If a particular conventional carton packaging is deemed to provide inadequate shock/vibration protection, there is no predictable way to modify such packaging material to meet such shock/vibration dissipation requirements, except for adding more packaging material and increasing the shipping carton size.

More recently, unitary packaging structures have been developed that are made of flexible polymeric materials to allow shocks to dissipate through flexing of the structure walls. Examples of such unitary structures can be found in U.S. Pat. Nos. 5,226,543, 5,385,232, and 5,515,976. However, these unitary packaging structures are typically designed to dissipate shocks primarily in one direction and/or fail to provide adequate shock/vibration protection under the more stringent performance specifications from fragile article manufacturers. Further, such unitary packaging structure designs are not easily adaptable to predictably change their shock/vibration dissipation performance to meet new and/or changing specifications. For example, if a drop test indicates there is insufficient shock dissipation in one direction, there is no easy modification that can be made to predictably change the shock dissipation performance in that direction without unpredictably affecting shock/vibration dissipation performance in other directions.

U.S. Pat. No. 5,799,796 proposes a system for solving the aforementioned problems comprising a light, inexpensive unitary spring system end cap packaging structure that efficiently dissipates shocks and vibrations while using a minimal amount of carton space during use, and a minimal amount of storage space before and after use. The system can be adapted to meet a wide range of shock/vibration dissipation requirements without using voluminous amounts of material.

The unitary spring system end cap of '796 includes a platform portion dimensioned to support at least a portion of a shock/vibration sensitive article and a sidewall structure. The sidewall structure includes an inner wall having proximal and distal edges, where the distal edge is joined to the platform portion, an outer wall having upper and lower edges, and at least one spring system integrally joined to the proximal edge of the inner wall and the upper edge of the outer wall. The spring system spaces the inner wall from the outer wall. The spring system includes at least one flexible harmonic bellows forming a flexible ridge that, for example, can have an arcuate shape along the length of the sidewall structure. The outer wall extends below the distal edge of the inner wall so that the platform portion is supported above the lower edge of the outer wall.

SUMMARY

The present invention provides one or more structures to enhance the shock response of a unitary spring system end cap. The one or more structures can include at least one rib formed in an outer wall of the unitary spring system end cap. The at least one rib can protrude from the outer wall, for example centered along the length of at least one spring system. When a carton containing a product protected by a unitary spring system end cap is dropped from a height, the rapid deceleration caused by an impact with a surface causes the at least one rib to engage the spring system on which it is centered. The present invention also provides at least one bulbous feature formed in a platform of the end cap. The at least one bulbous feature can absorb compressive forces applied to the platform, crushing in a controlled manner. Other objects and features of the spring system end caps of the present invention will become apparent by a review of the specification and appended figures.

BRIEF DESCRIPTION OF THE FIGURES

Further details of embodiments of the present invention are explained with the help of the attached drawings in which.

DETAILED DESCRIPTION

The present invention comprises a multiple spring system end cap packaging structure of unitary construction for supporting and protecting a shock/vibration sensitive article inside a shipping carton by dissipating shocks and vibrations experienced by the carton using a plurality of spring systems. The spring system end caps are nestable for space efficient storage before and after use, utilize minimal carton space to dissipate such shocks and vibrations, are lightweight, and have a structural design that can be easily modified to predictably meet a wide range of shock/vibration dissipation requirements.

Figure 1:
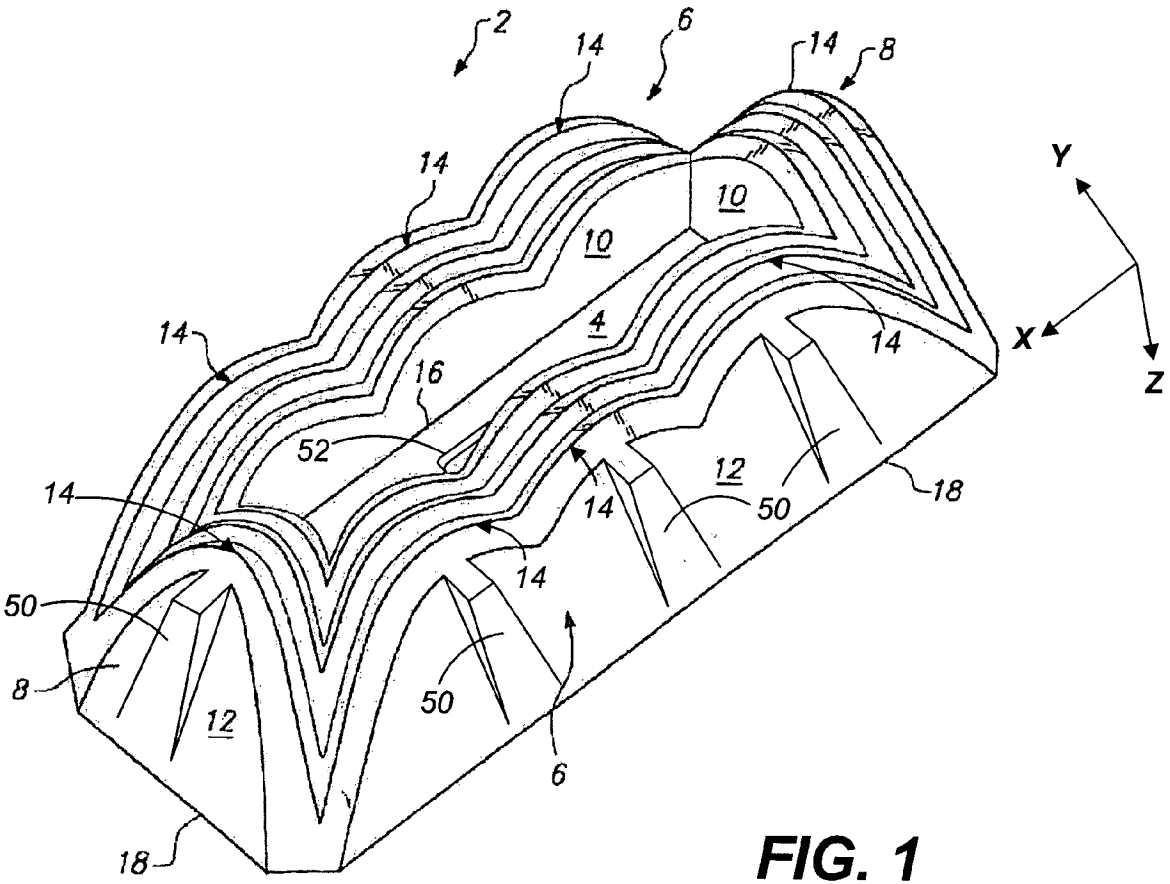
FIG. 1 is a perspective view of a spring system end cap having a plurality of ribs and a bulbous feature in accordance with one embodiment of the present invention.

As shown in FIG. 1, the multiple spring system end cap packaging structure can include one or more structures to enhance the shock response of a spring system end cap 2, including at least one rib 50 formed on an outer wall 12 of the spring system end cap 2. For example, the at least one rib 50 can protrude from the outer wall 12 centered along the length of each spring system 14. When a carton containing a product protected by a spring system end cap 2 is dropped from a height, the rapid deceleration caused by an impact with a surface causes the at least one rib 50 to engage the spring system 14 on which it is centered. Further, when an impact strikes a carton such that a force is transferred toward an exterior peripheral side of an end cap 2, the impact will affect the at least one rib 50 so that the at least one rib 50 engages the spring system 14 on which it is centered.

In addition, or alternatively, the multiple spring system end cap packaging structure can include at least one bulbous feature 52 located along a platform 4 of a spring system end cap 2. The bulbous feature 52 can absorb forces and crush in a controlled manner, allowing a manufacturer or shipper to package less sensitive portions of an article or articles near a likely crush zone, for example, to prevent damage to more sensitive portions.

A spring system end cap 2 as described in U.S. Pat. No. 5,799,796 to Azelton, et al. is shown in FIGS. 2A–2F. The spring system end cap 2 of FIG. 2A includes a platform 4 supported by sidewall structures 6 and 8. The sidewall structures 6/8 each include an inner wall 10 and outer wall 12 which are connected together by one or more spring systems 14. The lower edge 16 of the inner walls 10 joins with and supports platform 4. The outer walls 12 extend below platform 4 to define a cushion space 19 (shown in FIG. 2E) between the lower edge 18 of outer walls 12 and platform 4. Dimples 21 can optionally be formed protruding from inner walls 10 to create a friction fit between the article and the inner walls 10.

Each spring system 14 includes one or more parallel arced harmonic bellows 20 extending along the length of each sidewall structure 6/8. Bellows 20 are each formed by two elastic plates 22 attached together at an angle $\alpha$ to form a ridge 24 with a cross-sectional radius of curvature r. Ridges 24 extend in, and have an arcuate shape in, the longitudinal (lengthwise) direction of sidewall structures 6/8 to form arcs 27. If a spring system 14 contains more than one harmonic bellows 20, the bellows 20 are formed side by side with the bottom edges of elastic plates 22 from adjacent bellows 20 being joined together to form a channel 26 between the ridges 24. Channel 26 also extends in, and has an arcuate shape in, the longitudinal (lengthwise) direction of sidewall structures 6/8. If a sidewall structure 6/8 has more than one spring system 14, the ridges from the spring systems 14 are formed end to end resulting in a plurality of arcs 27 connected end to end along the length of that sidewall structure 6/8.

For each spring system 14, the innermost elastic plate 22 joins with the inner wall 10, and the outermost elastic plate 22 joins with the outer wall 12. The embodiment illustrated in FIGS. 2A–2F includes sidewall structures 6 having three spring systems 14 each with three harmonic bellows 20, and sidewall structures 8 having one spring system 14 with three harmonic bellows 20.

Figure 3:
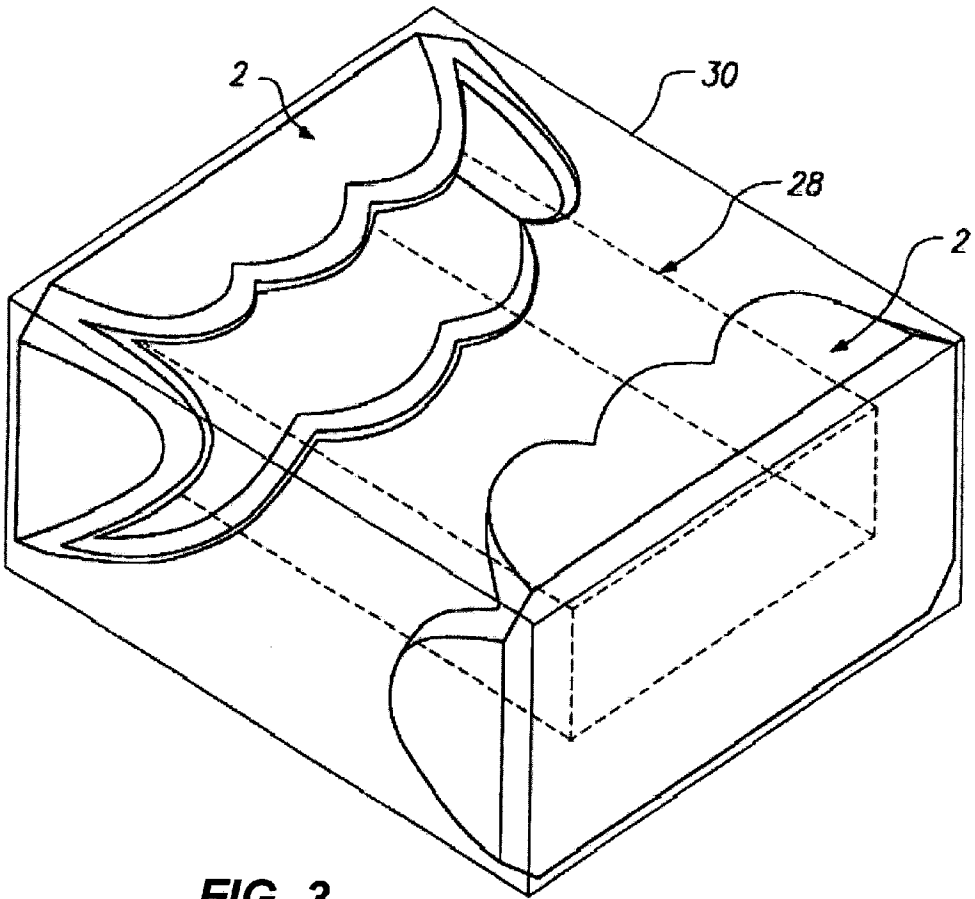
FIG. 3 is a perspective view of a shock sensitive article supported by a pair of spring system end caps within a shipping carton.

FIG. 3 illustrates the manner in which a pair of end caps 2 can support a fragile article 28 inside a shipping carton 30. The end caps 2 support opposing ends of the article via the inner walls 10 and platform 4. The end caps 2 are supported inside the shipping carton by outer wall lower edges 18, which abut the inside surfaces of the shipping carton 30. The above described end caps 2 provide deceleration of the article 28 supported thereby when an external shock force is applied to the shipping carton 30, as described below.

Figure 2A:
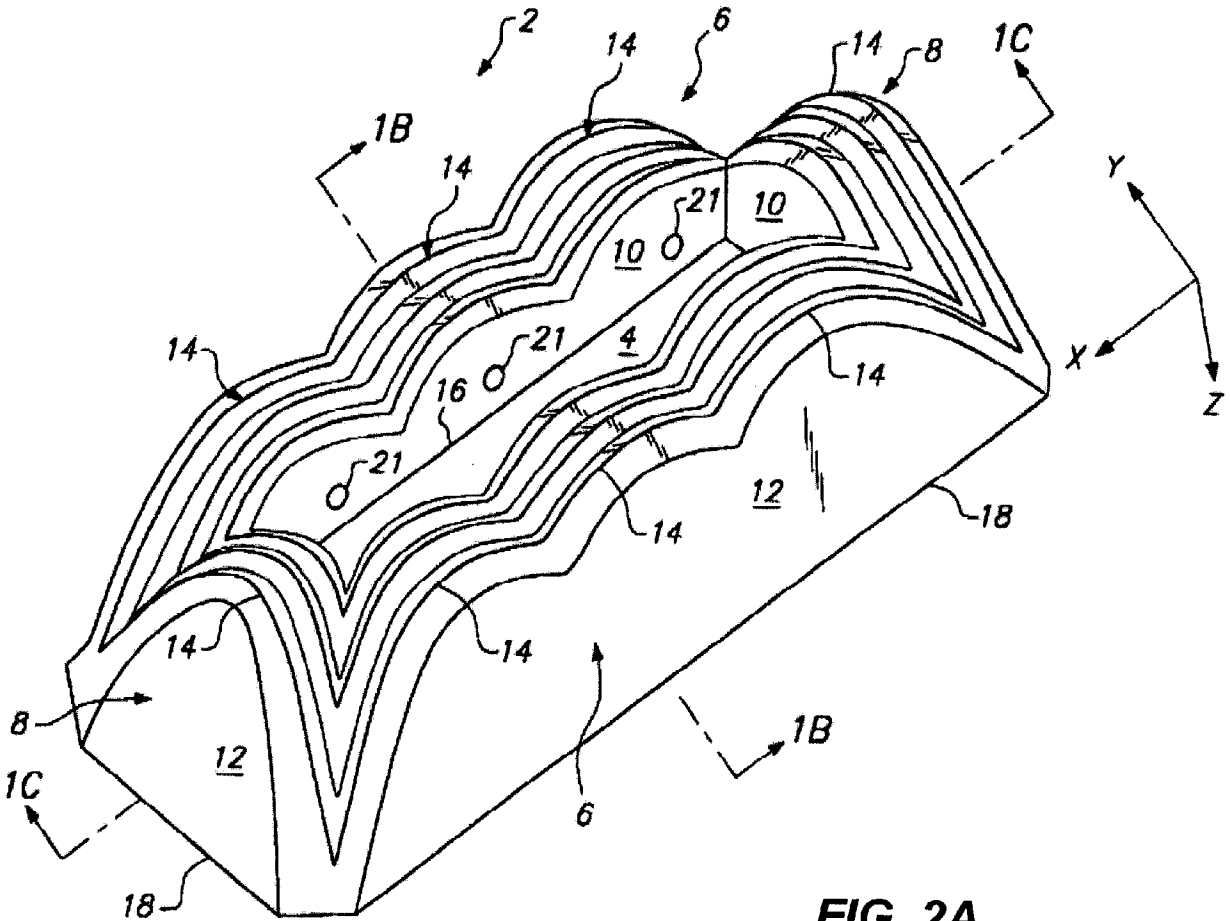
FIG. 2A is a perspective view of a spring system end cap lacking a rib structure or bulbous feature.
Figure 2B:
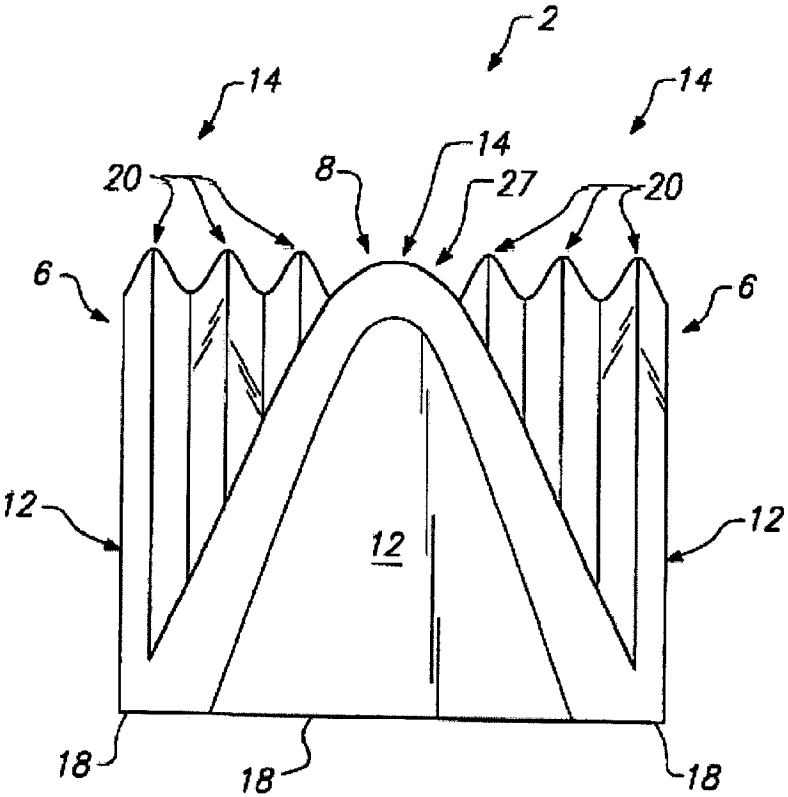
FIG. 2B is an end view of the spring system end cap of FIG. 2A.
Figure 2C:
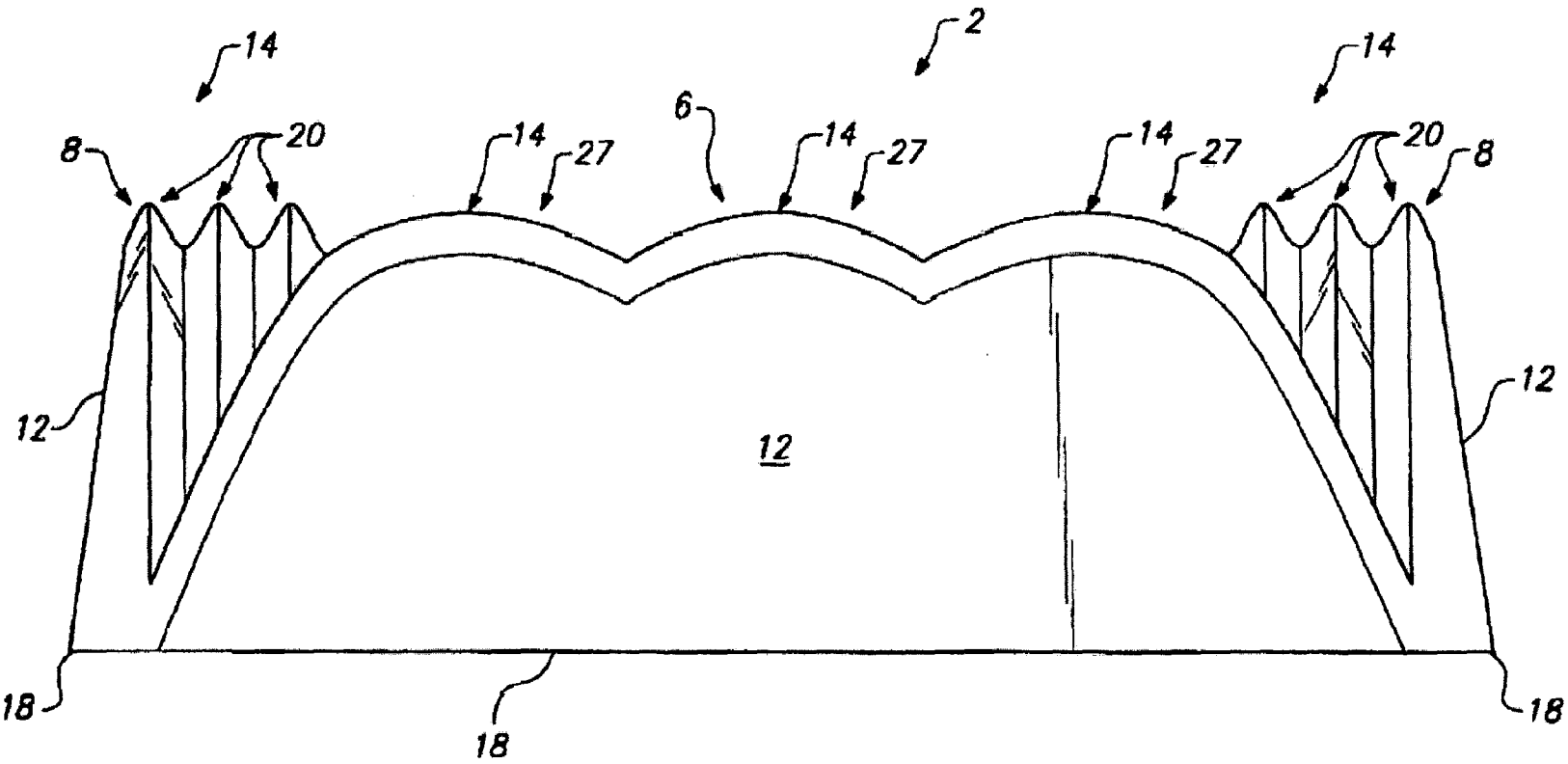
FIG. 2C is a side view of the spring system end cap of FIG. 2A.
Figure 2F:
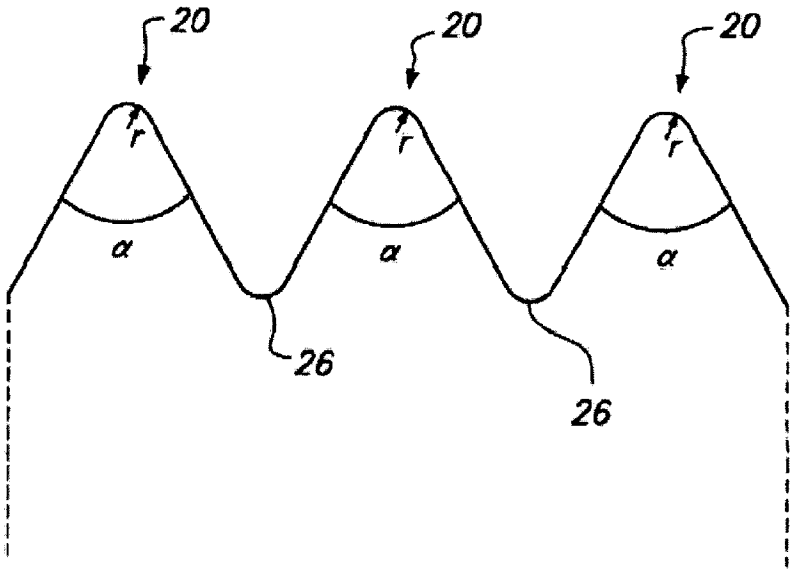
FIG. 2F is a close-up cross-sectional view of the sidewall structure of FIGS. 2D and 2E illustrating the radius of curvature of the top of the ridges of the harmonic bellows.
Figure 2D:
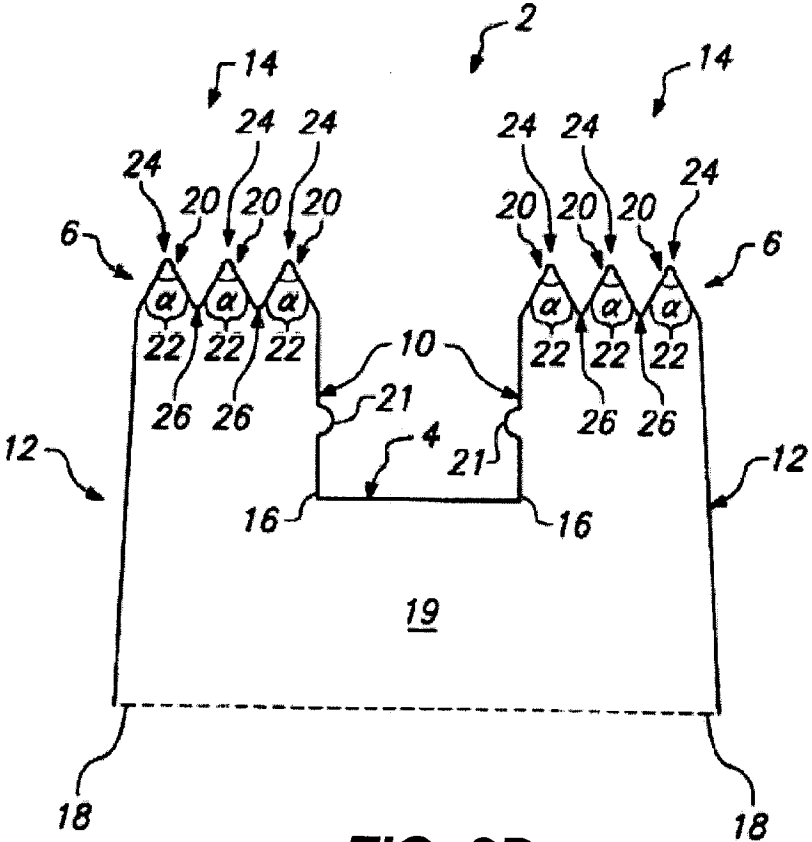
FIG. 2D is a cross-sectional end view of the spring system end cap of FIG. 2A illustrating a harmonic bellows in the sidewall structures.
Figure 2E:
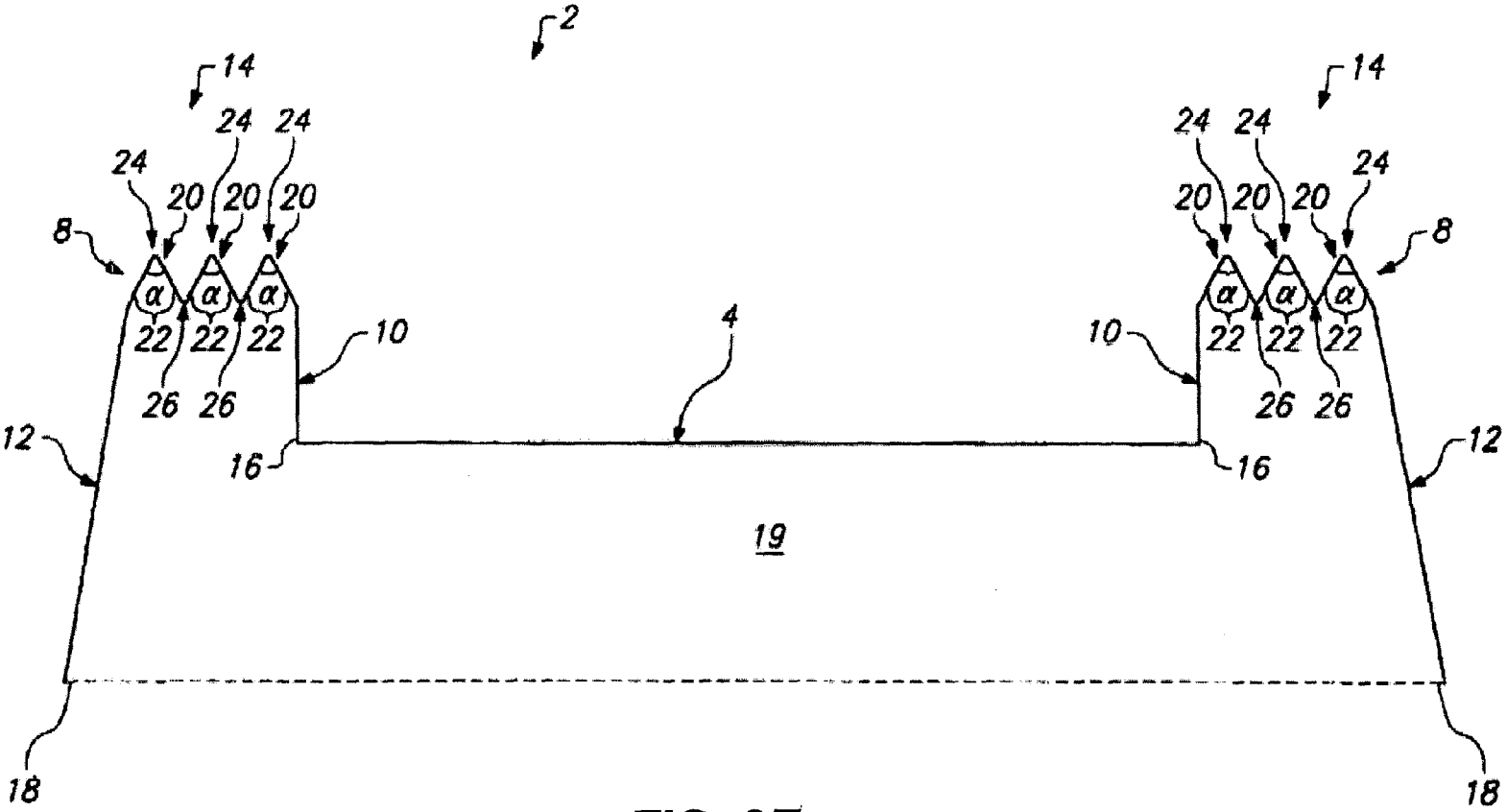
FIG. 2E is a cross-sectional side view of the spring system end cap of FIG. 2A illustrating the harmonic bellows in the sidewall structures.
Figure 4B:
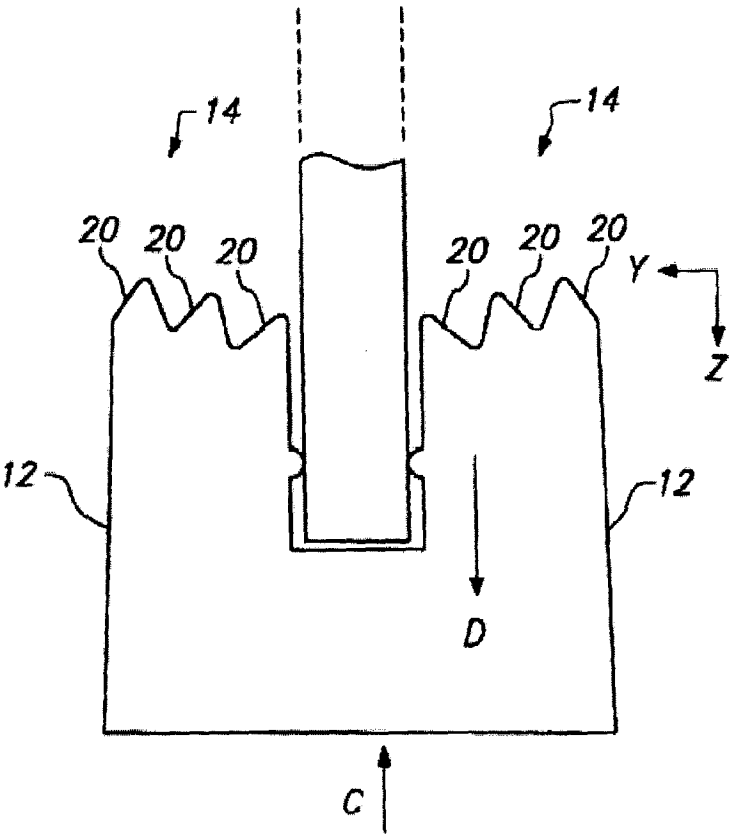
FIG. 4B is a cross-sectional end view of the spring system end cap of FIG. 4A illustrating the compression and expansion of the harmonic bellows upon vertical displacement of the platform.
Figure 4A:
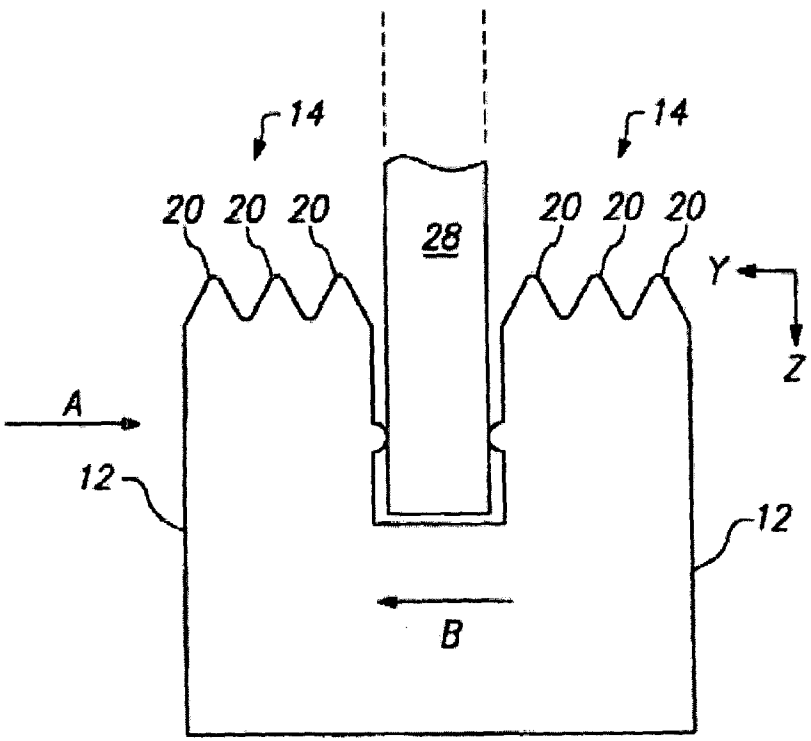
FIG. 4A is a cross-sectional end view of a spring system end cap illustrating the compression and expansion of the harmonic bellows upon horizontal displacement of the platform.

Shock forces impinging the shipping carton 30 and translated to each end cap 2 can be broken down into two horizontal components X and Y, and one vertical component Z, as illustrated in FIGS. 2A, 4A and 4B. The horizontal components of any shock force or vibration are dissipated by the sidewall structures 6/8 by inducing a stretching and compression of the harmonic bellows 20. FIG. 4A illustrates a Y component force and its effects on sidewall structures 6. A shock force in the direction of arrow A causes the platform 4 to displace in direction of arrow B, which causes the harmonic bellows 20 on the left of the platform 4 to compress together, and the bellows 20 on the right of the platform 4 to expand. During such bellows compression/expansion, the material that forms the ridges 24 and the channels 26 is stressed, thus absorbing the energy of the force. After the energy of the shock is absorbed by harmonic bellows 20, the bellows 20 on the left of the platform 4 resiliently expand and the bellows 20 on the right of platform 4 resiliently contract back to their natural uncompressed/unexpanded form, thus restoring the platform 4 to its original position. A similar bellows compression/expansion occurs for platform displacements in the direction of arrow A, as well as in sidewall structures 8 for X component forces. Vibrations are also similarly absorbed by sidewall structures 6/8, but with only minimal platform displacement in the X and Y axes.

The vertical components of any shock force or vibration are dissipated by the sidewall structures 6/8, as illustrated in FIG. 4B. A shock force in the direction of arrow C causes the platform 4 to displace in direction of arrow D, which in turn causes the harmonic bellows 20 in both sidewall structures 6/8 to rock inward and expand toward the platform 4 while the outer wall 12 deflects inwardly. The material that forms the ridges 24 and the channels 26 is stressed, thus absorbing the energy of the force. After the energy of the shock is absorbed by harmonic bellows 20, the bellows 20 resiliently contract back to their natural unexpanded form, thus restoring the platform 4 to its original position. The corners of the end caps 2 are formed so that when all the bellows 20 rock inwardly, the bellows 20 on either side of each corner do not interfere with each other during the downward deflection of the platform 4. A similar bellows compression/expansion occurs for platform displacements in the direction of arrow C (to the extent that the article can pull up on inner walls 10). Vibrations are also similarly absorbed by sidewall structures 6/8, but with only minimal platform displacement in the Z axes.

It should be noted that spring systems 14 in the sidewall structures 6 can be made to operate more independently from spring systems 14 in the sidewall structures 8 by making the bellows thicknesses on either side of the corners equal. This will ensure the least amount of operational interference across the end cap corners.

Each bellows 20 of each spring system 14 operates independently during a shock or vibration. Therefore, if a shock force has both horizontal and vertical (X, Y, and Z) components, then each spring system 14 works independently to absorb the energy of that shock force.

The arcuate shape of the bellows 20 provides strength along the length of each sidewall structure 6/8, and prevents the bellows 20 from buckling during large deflections of the platform 4. In other embodiments, bellows 20 can be formed having an alternative shape. For example, the bellows 20 can have a trapezoidal shape, as shown in FIG. 5J, or the bellows 20 can have a rectangular or square shape. The bellows 20 can have myriad other shapes. The invention should not be construed as being limited to spring system end caps 2 including bellows 20 having arcuate shape.

The maximum g-force and vibration experienced by the article is dictated by the overall stiffness of the end cap 2 in the direction of the force/vibration. If the spring systems 14 are too soft, then the bellows 20 will completely collapse together so the platform will hit the outer wall 12, and/or the platform 4 will be deflected beyond outer wall lower edge 18 to contact the side of the shipping carton, either of which will increase the maximum force experienced by the article. If the spring systems 14 are too stiff, then the bellows 20 will not sufficiently compress and expand to absorb and dissipate a sufficient amount of energy from the shock or vibration, which will also increase the maximum force/vibration experienced by the article. Therefore, each spring system 14 needs to have a certain stiffness, so the overall stiffness of the end cap 2 in any given direction will result in the maximum amount of shock/vibration absorption and dissipation, without the platform contacting the outer walls 12 or the shipping carton.

The overall end cap stiffness in any given direction is a function of a number of end cap design parameters. Generally, overall end cap stiffness is increased by increasing, either individually or in combination, any of the following end cap design parameters: the number of spring systems 14 in each sidewall structure 6/8 (i.e. the number of arcs 27), the radius of curvature of the spring system arcs 27, the number of bellows 20 in each spring system 14, the ridge angles a between the elastic plates 22 of the various bellows 20, the cross-sectional radius of curvature r of the ridge, the length of the elastic plates 22, and the flexibility/thickness of the material used to form the end cap 2. Also, decreasing the area of the platform 4 can increase stiffness for vertical platform deflections because the inner walls 10 better engage the article to resist the bellows 20 from rotating inwardly during platform deflection. In addition, increasing the cushion space 19 will provide additional distance for platform displacement, thus preventing the platform 4 from contacting the sides of the shipping carton. It should be noted that these end cap design parameters can differ from sidewall structure to sidewall structure, spring system to spring system, and even from bellows to bellows within the same spring system.

Each of the above design parameters can be individually adjusted to provide the desired end cap stiffness in any given direction, and at any location in end cap 2. Therefore, if a particular end cap design satisfies most of the shock/vibration dissipation requirements, it is easy to predict what end cap design parameters need adjusting to achieve those remaining requirements not yet satisfied. Further, the end cap design can be customized to provide different stiffness support for different portions of the article. For example, if an article is heavier at one end of the platform 4 than the other, then the spring systems 14 near the heavier end can be designed to accommodate the extra weight (i.e. by changing the ridge angles a on one or more the bellows 20 closest to that heavy end, or by adding an extra bellows 20 to those spring systems 14 supporting the heavy end, etc.). Each spring system 14 can have a unique stiffness, and each bellows 20 within that spring system 14 can embody different end cap design parameter values to achieve that unique stiffness. Because these design parameters operate relatively independently and predictably upon the stiffness of the end cap 2, these design parameters can be changed individually to fine tune the performance of the end cap to meet any given shock/vibration absorption requirement.

Figure 5A:
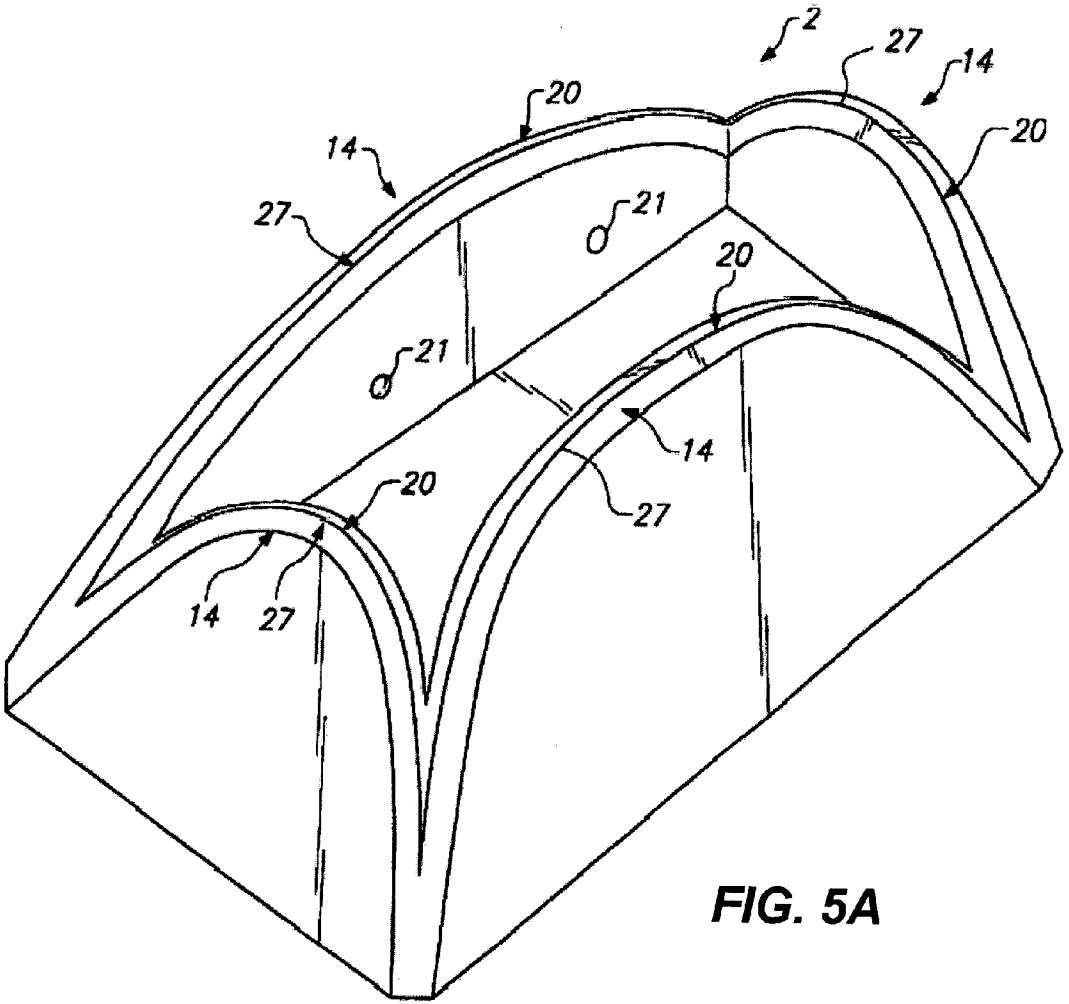
FIGS. 5A–5F are perspective views of alternative spring system end caps.
Figure 5B:
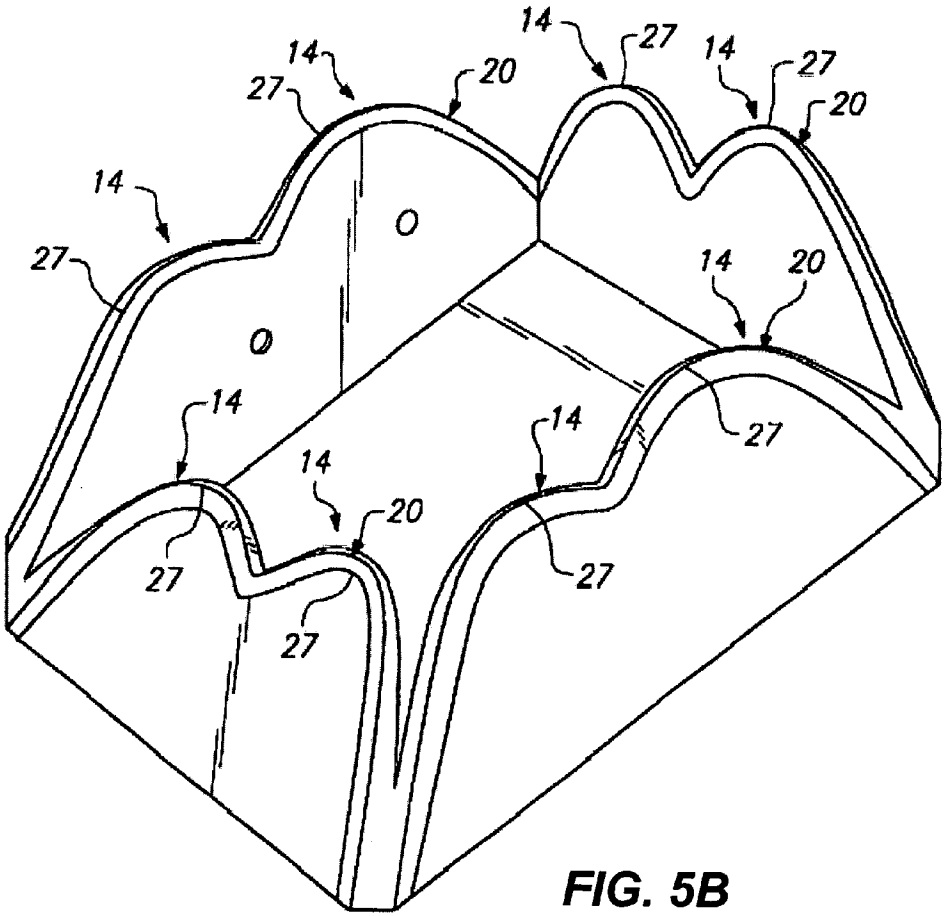
Figure 5C:
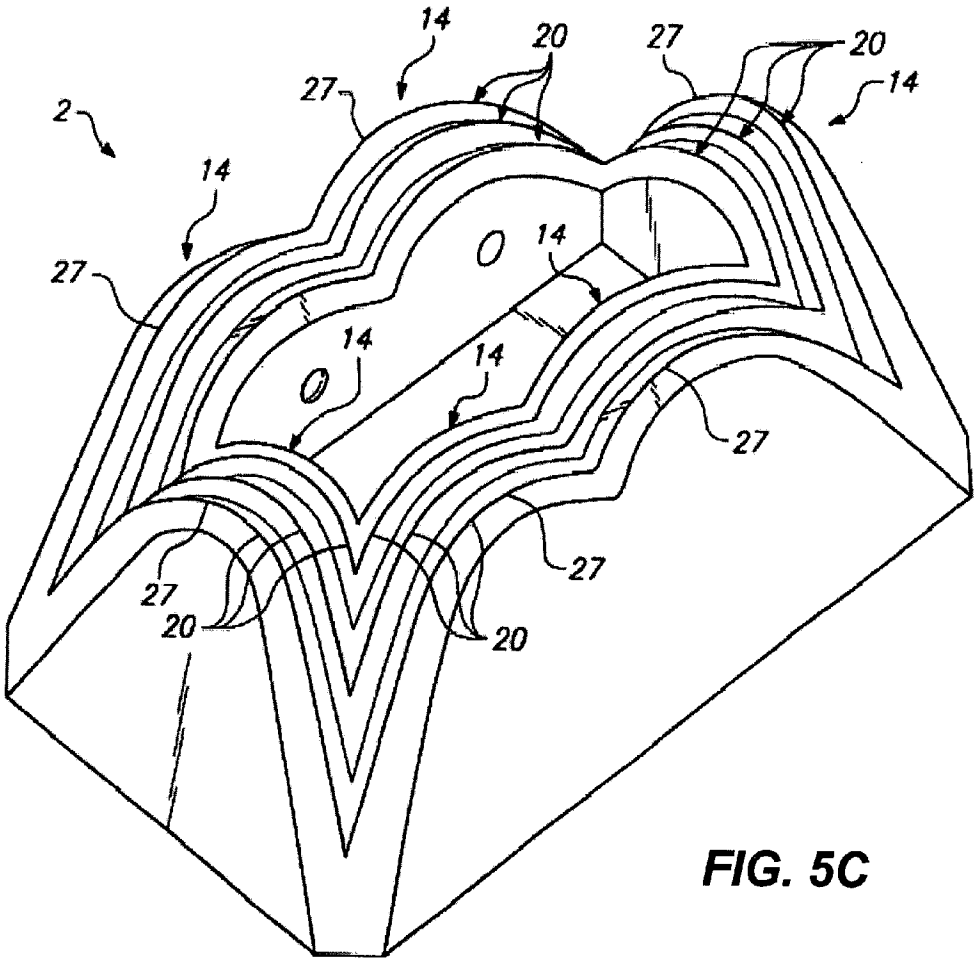
Figure 5D:
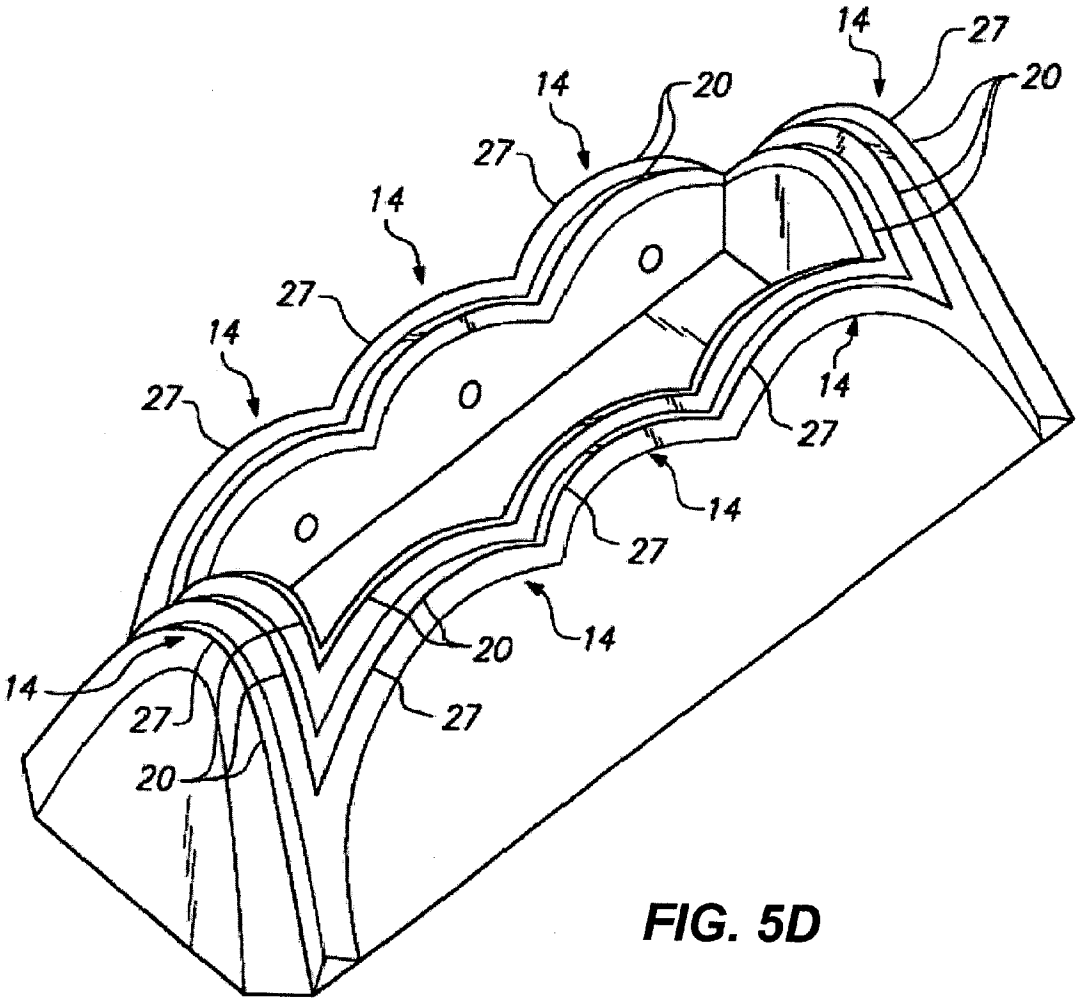
Figure 5E:
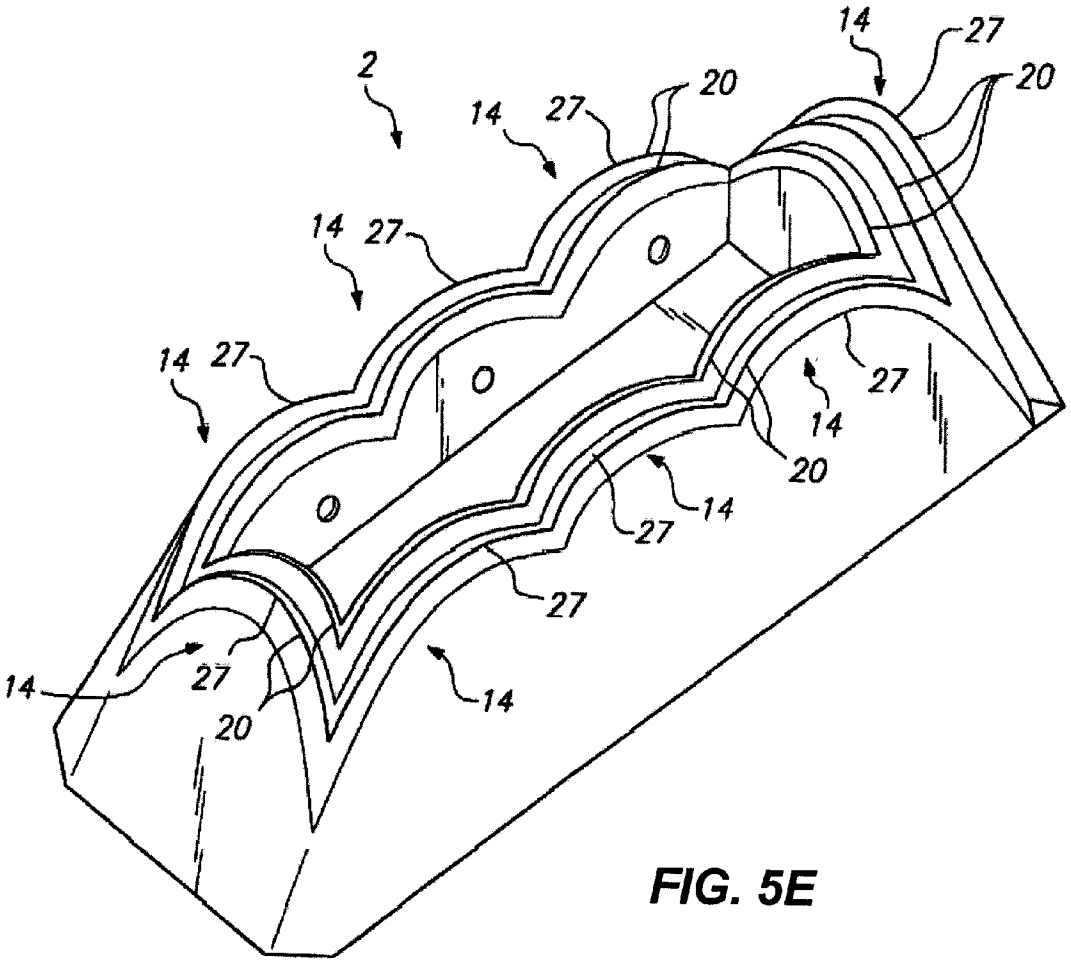
Figure 5F:
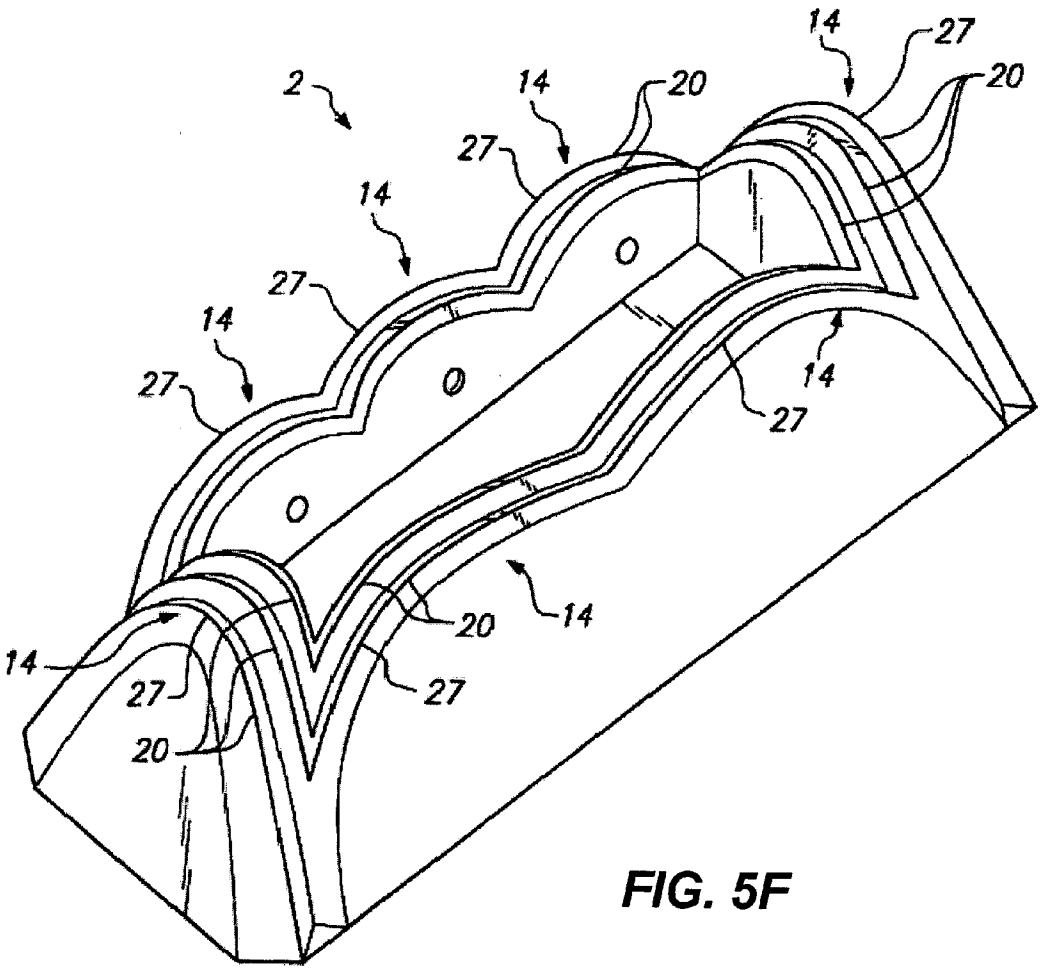
Figure 5G:
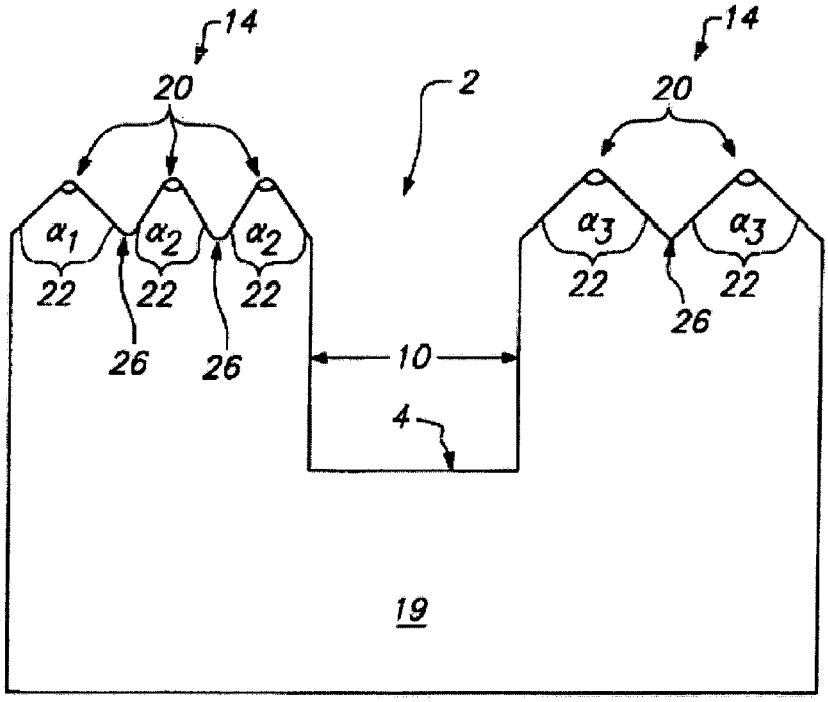
FIG. 5G is a cross-sectional end view of an alternative spring system end cap.
Figure 5I:
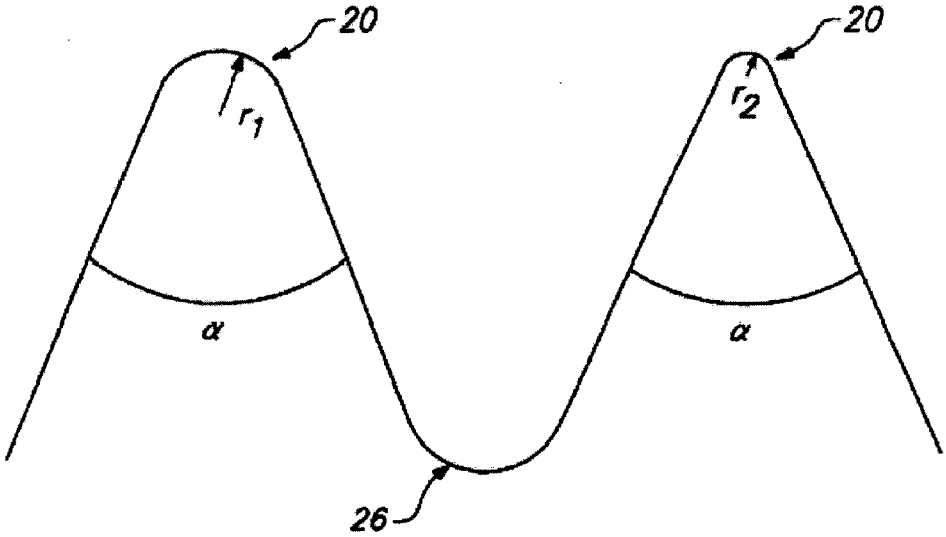
FIG. 5I is a close-up of a bellows having ridges of differing stiffness, for example ring system end cap of FIG. 5H.
Figure 5H:
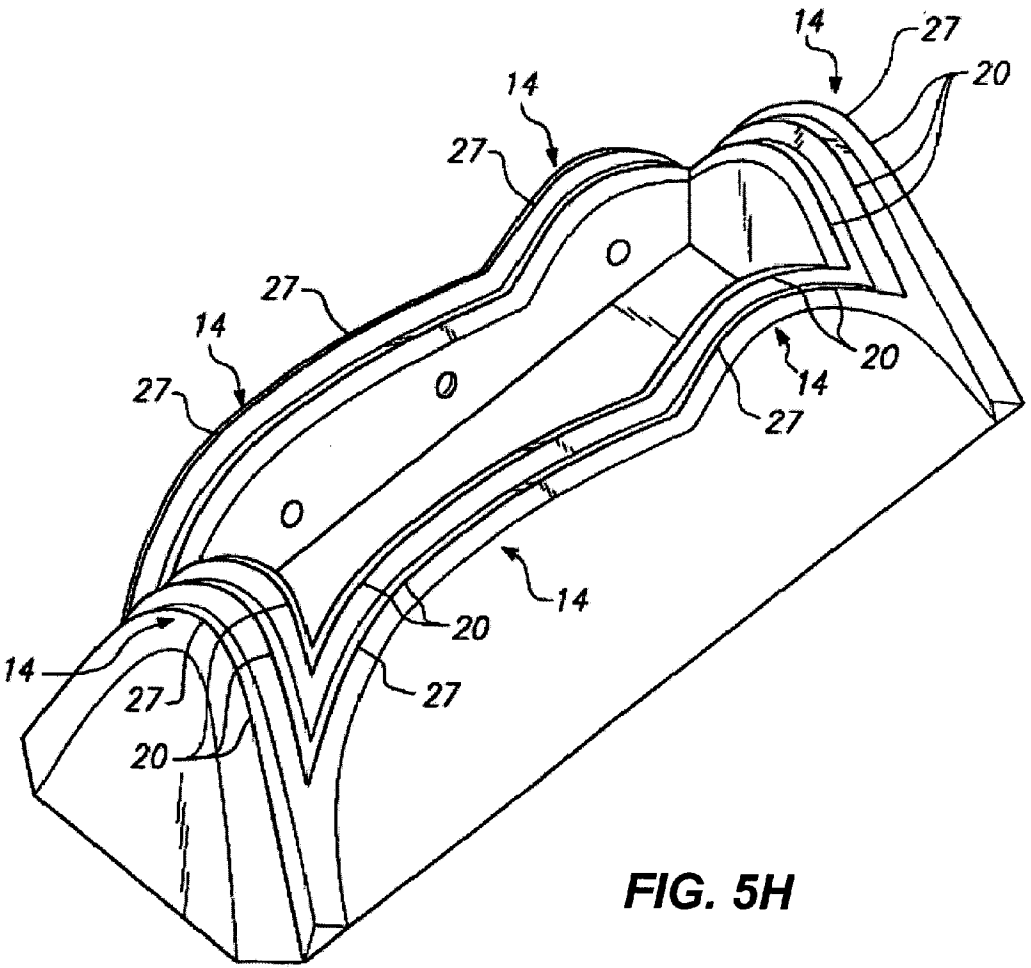
FIG. 5H is a perspective view of an alternative spring system end cap.
Figure 5J:
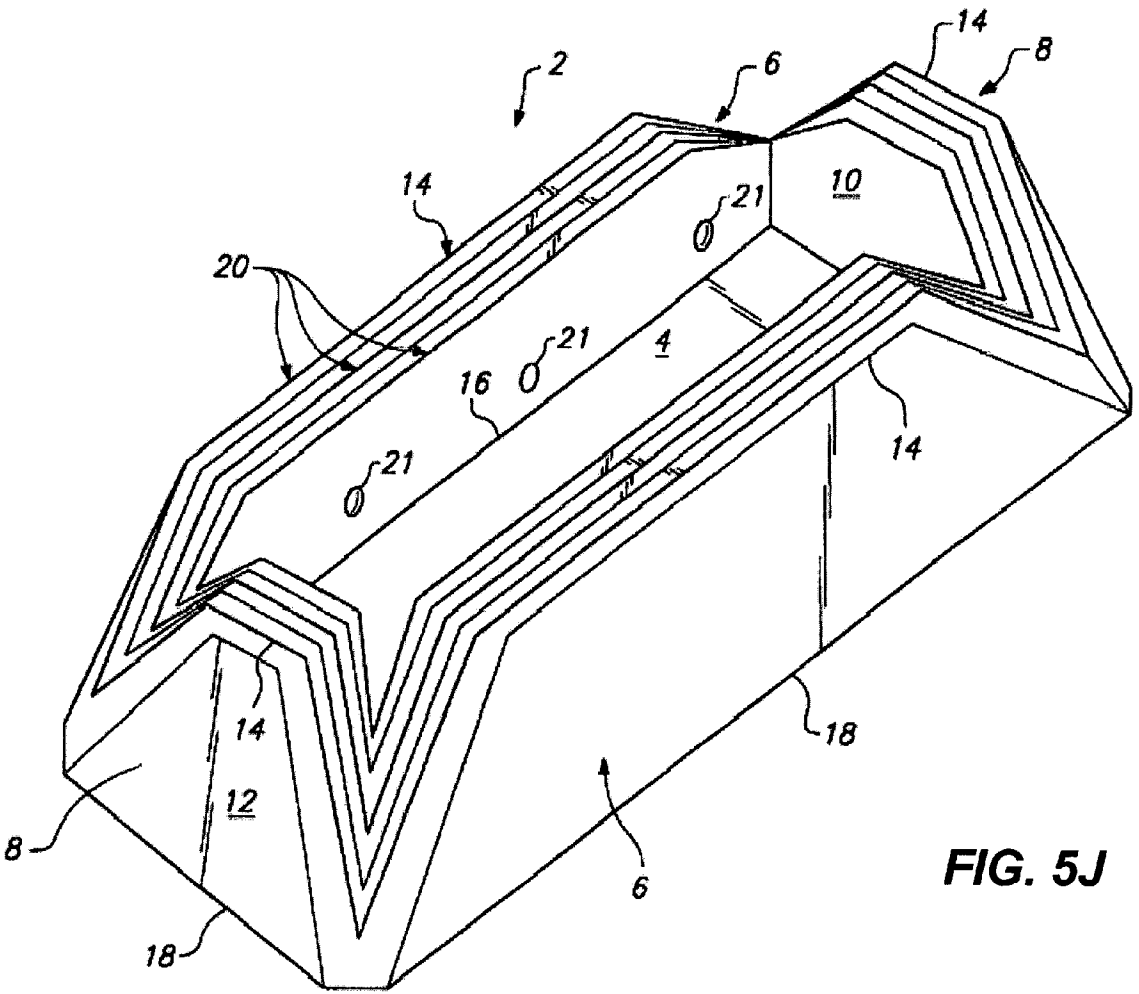
FIG. 5J is a perspective view of an alternative spring system end cap.
Figure 7C:
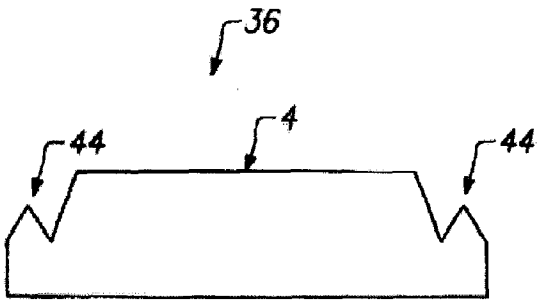
FIGS. 7C and 7D are cross-sectional side views of the spring system end cap of FIGS. 7A and 7B.
Figure 7D:
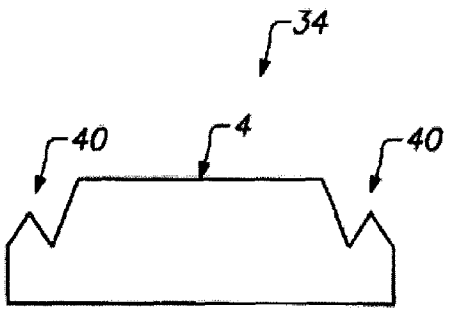
Figure 5K:
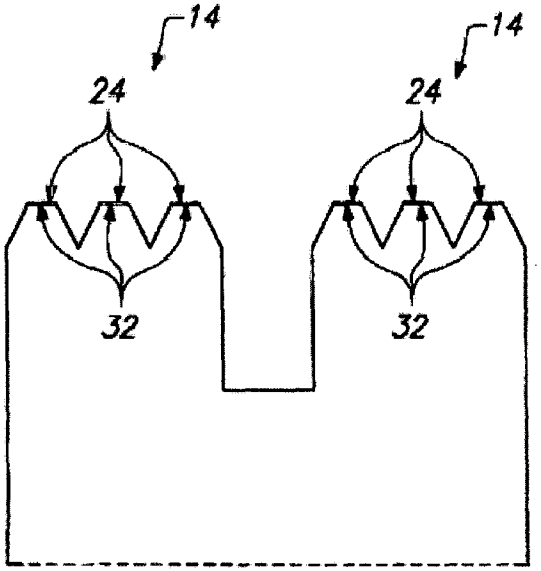
FIG. 5K is a cross-sectional end view of an alternative spring system end cap.

FIGS. 5A to 5K illustrate various end cap configurations, utilizing different combinations of end cap design parameters. For example, FIG. 5A illustrates an end cap 2 with one spring system 14 per sidewall structure 6/8, and one bellows 20 per spring system 14. FIG. 5B illustrates an end cap 2 with a plurality of spring systems 14 per sidewall structure 6/8, and one bellows 20 per spring system 14. FIG. 5C illustrates an end cap 2 with two spring systems 14 per sidewall structure 6 and one spring system 14 per sidewall structure 8, and a plurality of bellows 20 per spring system 14. FIG. 5D illustrates an end cap 2 where the sidewall structures 8 have more bellows 20 but fewer spring systems 14 than the sidewall structures 6. FIG. 5E illustrates an end cap 2 with one sidewall structure 8 having more bellows 20 than the other sidewall structure 8. FIG. 5F illustrates an end cap 2 with one sidewall structure 6 having more spring systems 14 than the other sidewall structure 6. FIG. 5G illustrates an end cap 2 with one sidewall structure 6 having different ridge angles $\alpha$, plate lengths, and number of harmonic bellows 20 than the other sidewall structure 6. FIG. 5H illustrates an end cap 2 with sidewall structures 6 containing spring systems 14 having arcs 27 of different radius' of curvature. FIG. 5I is a close-up cross-section of a sidewall structure 6, for example from the end cap 2 of FIG. 5H, having one ridge (with a cross-sectional radius of curvature $r_1$) that is stiffer than an adjacent ridge (with a cross-sectional radius of curvature $r_2$) because $r_1 > r_2$ FIG. 5J illustrates an end cap 2 with flat ridges (no arcs) but a plurality of harmonic bellows 20 in each sidewall structure 6/8. FIG. 5K illustrates ridges 24 with a flat top portion 32.

Figure 6A:
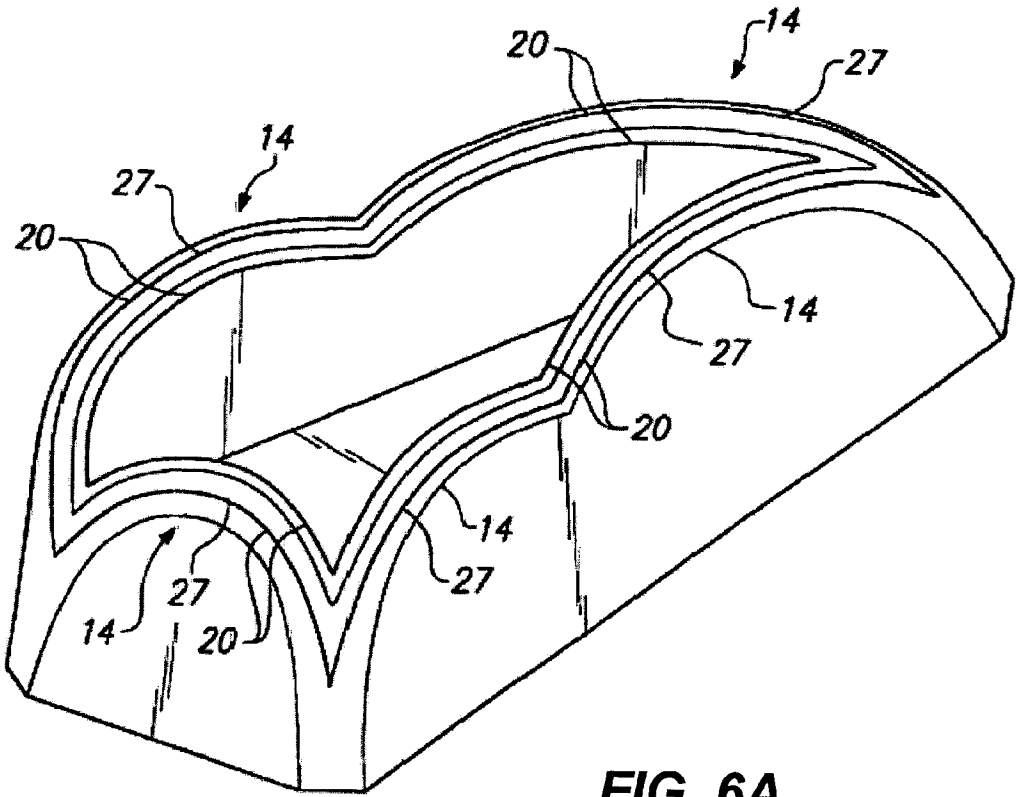
FIGS. 6A and 6B are perspective views of alternative spring system end caps.
Figure 6B:
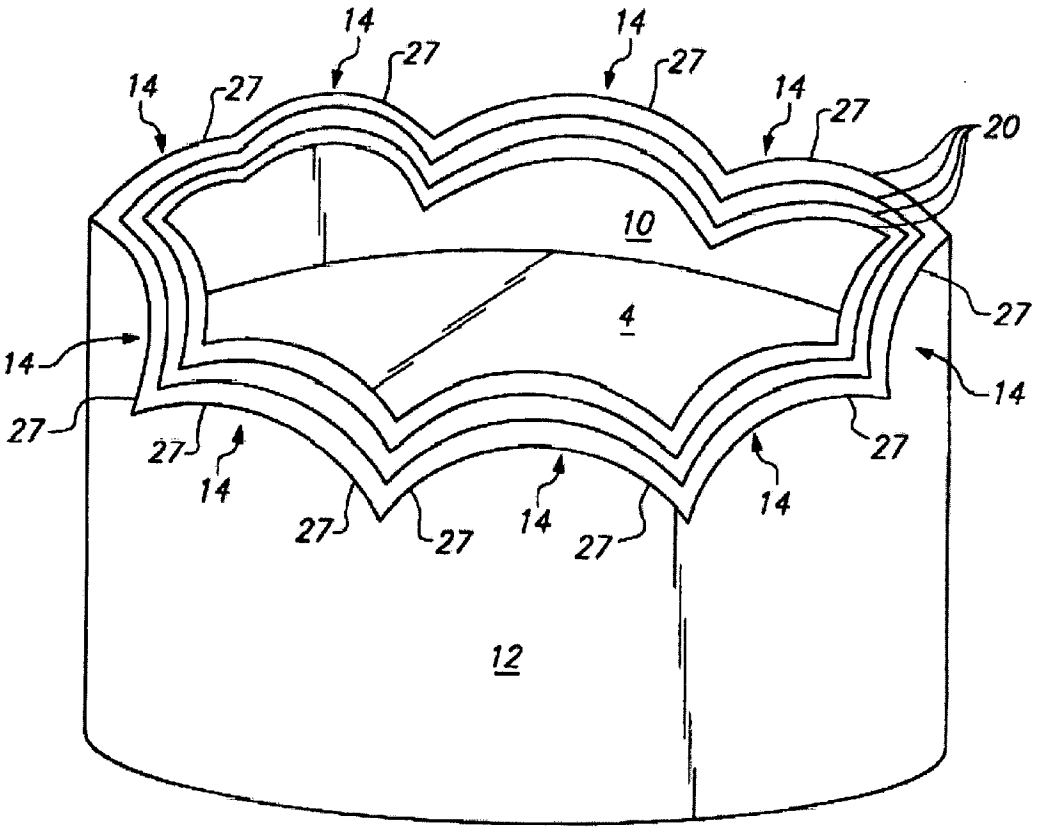

It should be noted that spring system end caps comprising the present invention are not limited to having rectangular (or square) platforms 4, but also can include platforms 4 of other shapes as well, such as triangular (as illustrated in FIG. 6A), circular (as illustrated in FIG. 6B), oval, etc. The platform dimensions and shape can be changed to best fit the shape of the article while providing the desired shock/vibration dissipation. Further, end caps 2 of different platform 4 shapes and end cap design parameter values can be used to support different portions of the same article.

Figure 7A:
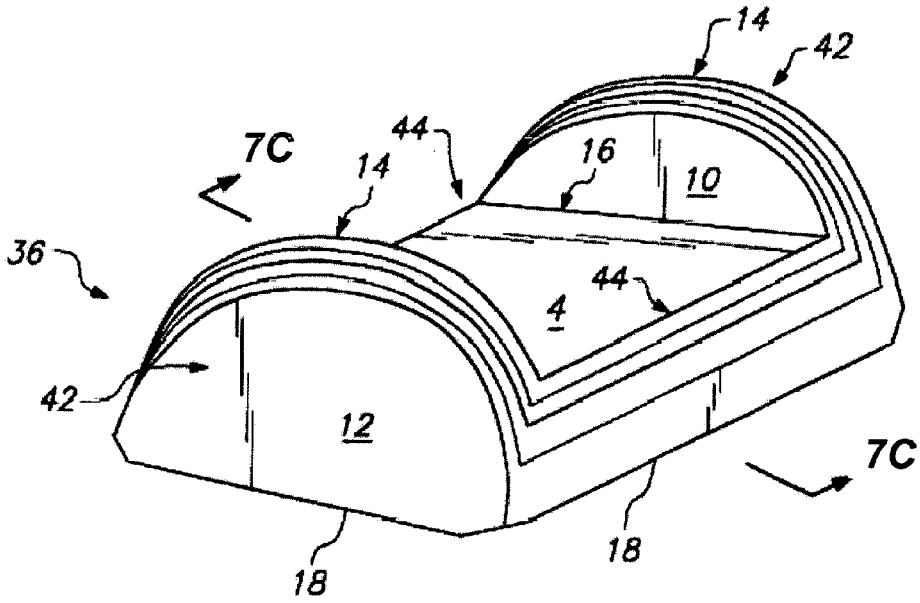
FIGS. 7A and 7B are perspective views of alternative spring system end caps.
Figure 7B:
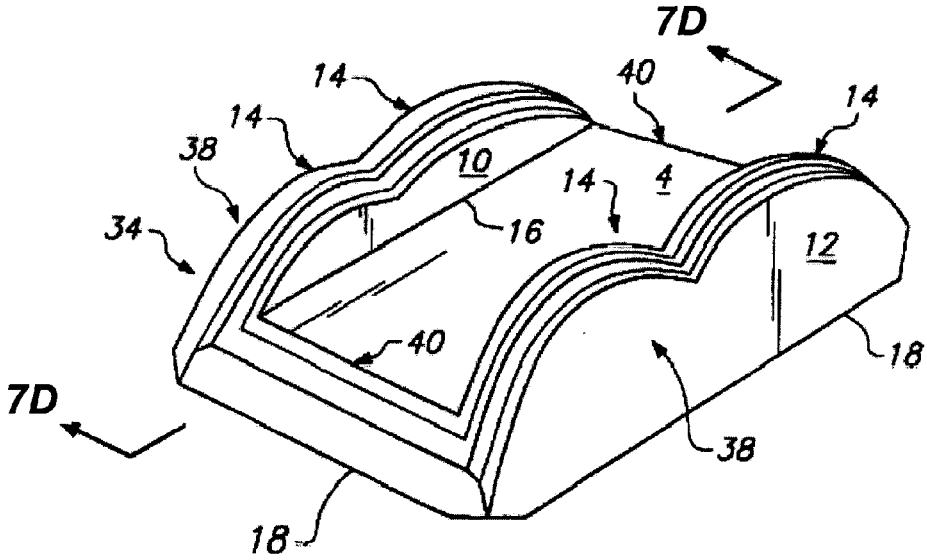

FIGS. 7A and 7B illustrate still other spring system end caps 34/36. The complimentary end caps 34/36 are ideal for supporting a small article therebetween. The end cap 34 of FIG. 7B includes sidewall structures 38 that extend above the platform 4 and sidewall structures 40 that are formed below the platform 4. Likewise, the end cap 36 of FIG. 7A has sidewall structures 42 that extend above the platform 4 and sidewall structures 44 that are formed below the platform 4. When a relatively small article is supported between the platforms 4 of the end caps 34/36, the sidewall structures 38 above the platform 4 of one end cap 34 are positioned opposite the sidewall structures 44 below the platform 4 of the other end cap 34, and the sidewall structures 40 below the platform 4 of the one end cap 34 are positioned opposite the sidewall structures 42 above the platform 4 of the other end cap 36. This configuration allows the platforms 4 of end caps 34/36 to be positioned closer together without the sidewall structures 38 and 40 interfering with opposing sidewall structures 42 and 44 respectively.

Figure 8A:
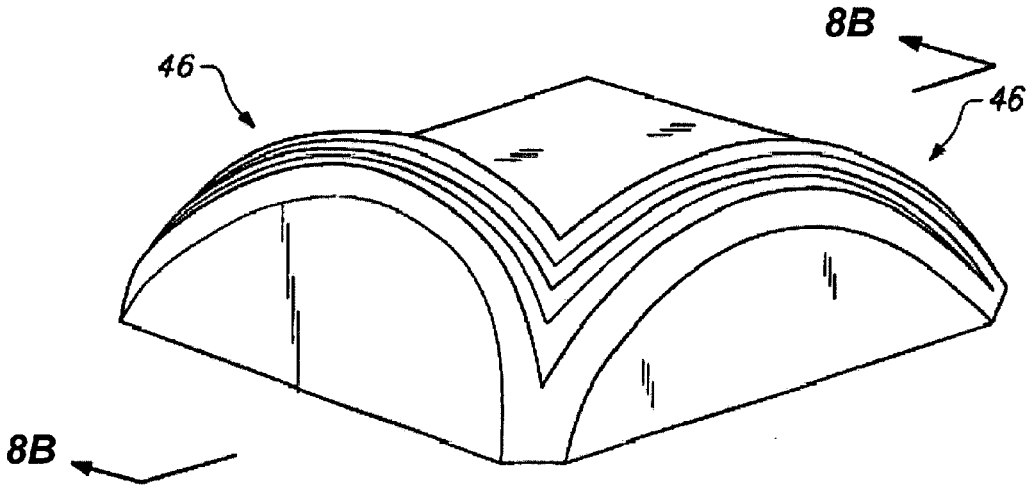
FIG. 8A is a perspective view of an alternative spring system end cap.
Figure 8B:
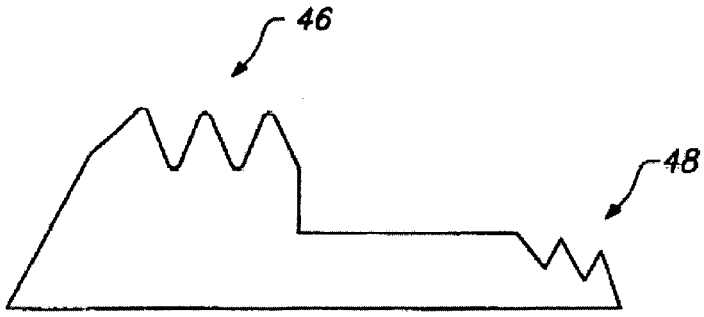
FIG. 8B is a cross-sectional side view of the spring system end cap of FIG. 8A.

FIGS. 8A and 8B illustrate another spring system end cap having an open ended platform 4 for holding just a portion of an article. Platform 4 terminates on two sides with adjacent sidewall structures 46 that extend above platform 4, and with adjacent sidewall structures 48 that are formed below platform 4. This end cap embodiment is ideal for supporting a portion of the article, such as one corner, that extends beyond the platform 4.

Figure 9A:
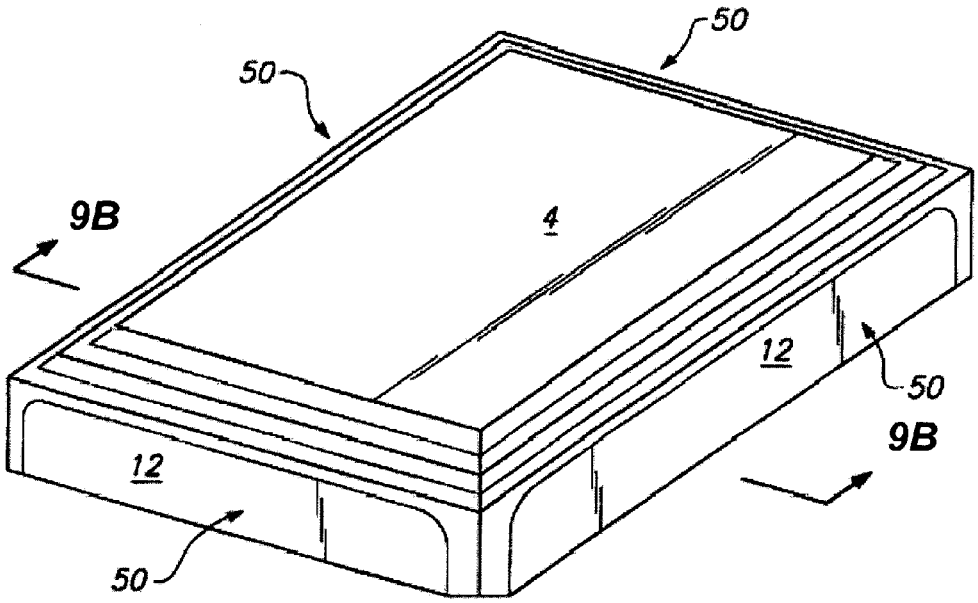
FIG. 9A is a perspective view of an alternative spring system end cap.
Figure 9B:
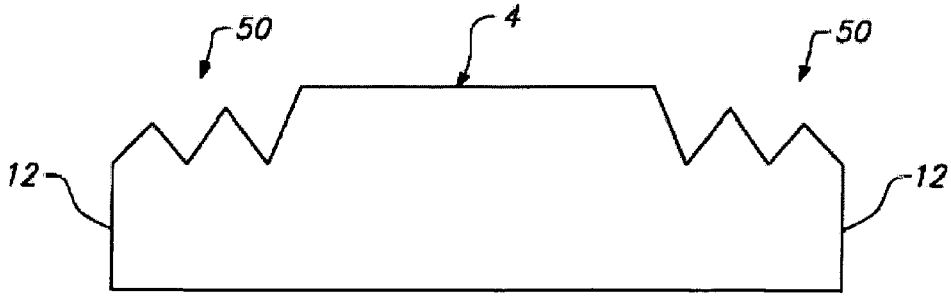
FIG. 9B is a cross-sectional side view of the spring system end cap of FIG. 9A.

FIGS. 9A and 9B illustrate an end cap having sidewall structures 48 on all sides of the platform that are formed entirely below the platform 4. This end cap is ideal for supporting a flat area portion of an article that is much larger than the area of the platform 4. The article can extend beyond the platform 4 without interfering with the sidewall structures 50.

As mentioned above, an end cap can be formed having a shape as described in FIG. 2A–9B, or the end cap can be formed having a different design. The end cap can have myriad different designs, and the examples provided are not intended to be exhaustive or represent a complete list of examples. One of ordinary skill in the art can appreciate the myriad different designs with which the end cap can be formed.

The shape of spring system end cap can be such that multiple spring system end caps can be fully nestable for efficient stackability to minimize storage space before and after use. The bellows design of the end caps results in minimal space requirements inside the carton for maximum cushion effect, thus reducing the carton size needed to safely ship any given article.

The end cap can be made from high density polyethylene, a recyclable material having good tensile and tear properties at low temperatures, providing resiliency for shock and vibration absorption. Other materials that can be used to make the end cap include: polyvinyl chloride, polypropylene, low density polyethylene, PETG, PET, styrene, and many other polymeric materials. In other embodiments, the end cap can be made from molded fiber and other composites, for example a composite having both fiber and polymeric materials. In still other embodiments, the end cap can be made from a foamed material having reduced density. The compound and/or composite material can further comprise non-polymeric materials such as glass, for providing stiffness as desired. One of ordinary skill in the art can appreciate the different materials from which the end caps can be shaped and formed. Because of the resiliency of the end cap material and spring system design, the end caps can be re-used repeatedly. Further, the end caps are lightweight to minimize shipment costs both of the end caps before use, as well as during shipment of the articles utilizing the end caps.

An end cap can preferably be manufactured by thermoforming. Further, the end cap can be manufactured by molding (for example by injection molding, or thin-walled molding) or by an alternative process such as extrusion. In molding, the end cap is formed in a mold and once formed, must be ejected or otherwise removed from the mold. Some manufacturers utilize a thin-walled molding process wherein injection is accelerated with nitrogen, reducing manufacturing time. To improve removal of an end cap, the mold can be designed such that the mold includes a draft. A draft is a slight taper given to a mold or die to facilitate the removal of a casting. The size of the draft can vary according to the composition of the resin injected into the mold, the depth of the mold relative to the width of the mold, the desired ease of removal of the end cap from the mold and other manufacturing considerations.

Figure 10A:
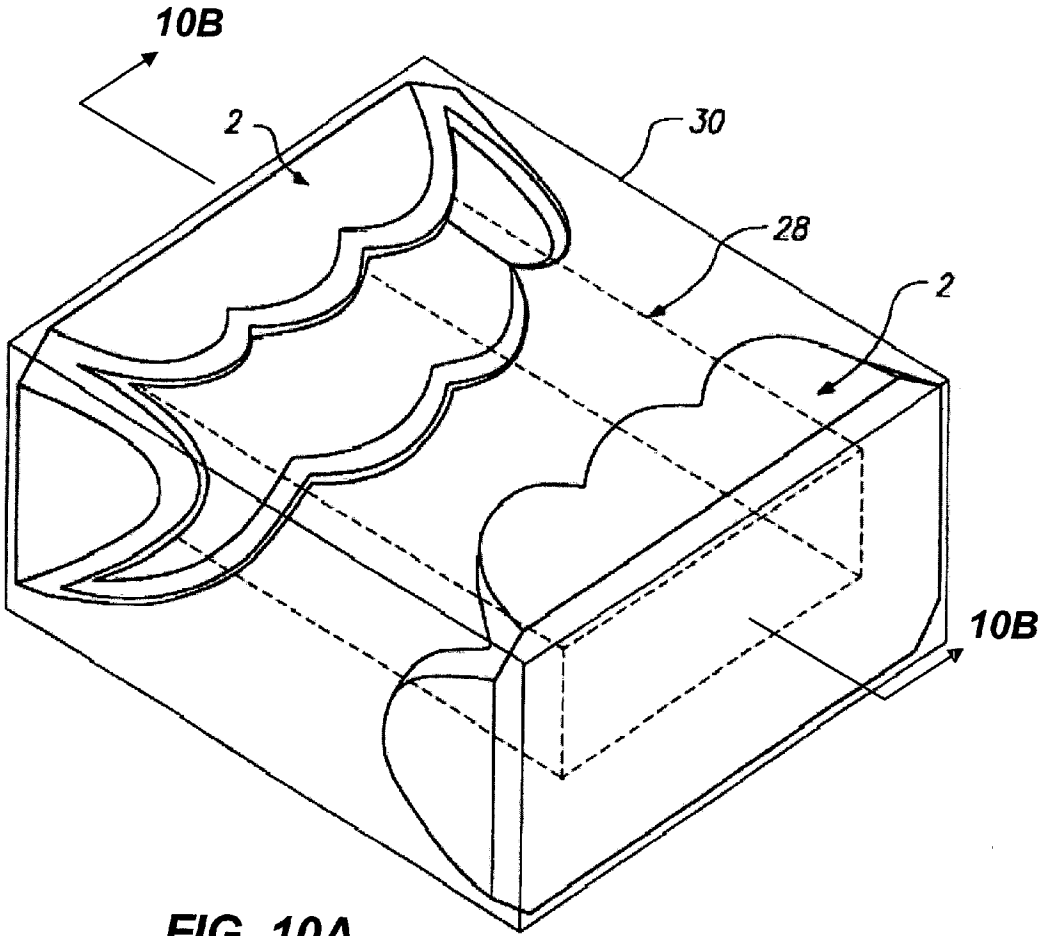
FIG. 10A is a perspective view of a shock sensitive article supported by a pair of spring system end caps within a shipping carton.

As described in reference to FIG. 3, and as can be seen in FIG. 10A, shipping cartons 30 used to contain fragile articles 28 associated with end caps 2 are typically orthogonal in shape, having walls with inside surfaces either roughly perpendicular or roughly parallel to each other wall of the shipping carton 30. In some circumstances, the spring systems 14 are ideally engaged where the end cap 2 comprises an outer wall 12 having a surface perpendicular to the platform 4 and parallel to an opposite outer wall 12 (where the end cap is rectangular), thus allowing the outer wall 12 to be flush against the inside surface of the shipping carton 30. Manufacturers using an injection molding process to produce an end cap 2 can achieve flushness by utilizing a zero-draft mold to eliminate taper in the outer walls 12. In a zero-draft mold, the sides of the part are formed by moving sections of the mold, eliminating the need for draft to release the part from the mold. However, zero-draft molds can be costly and impractical for volume manufacturing.

Figure 10B:
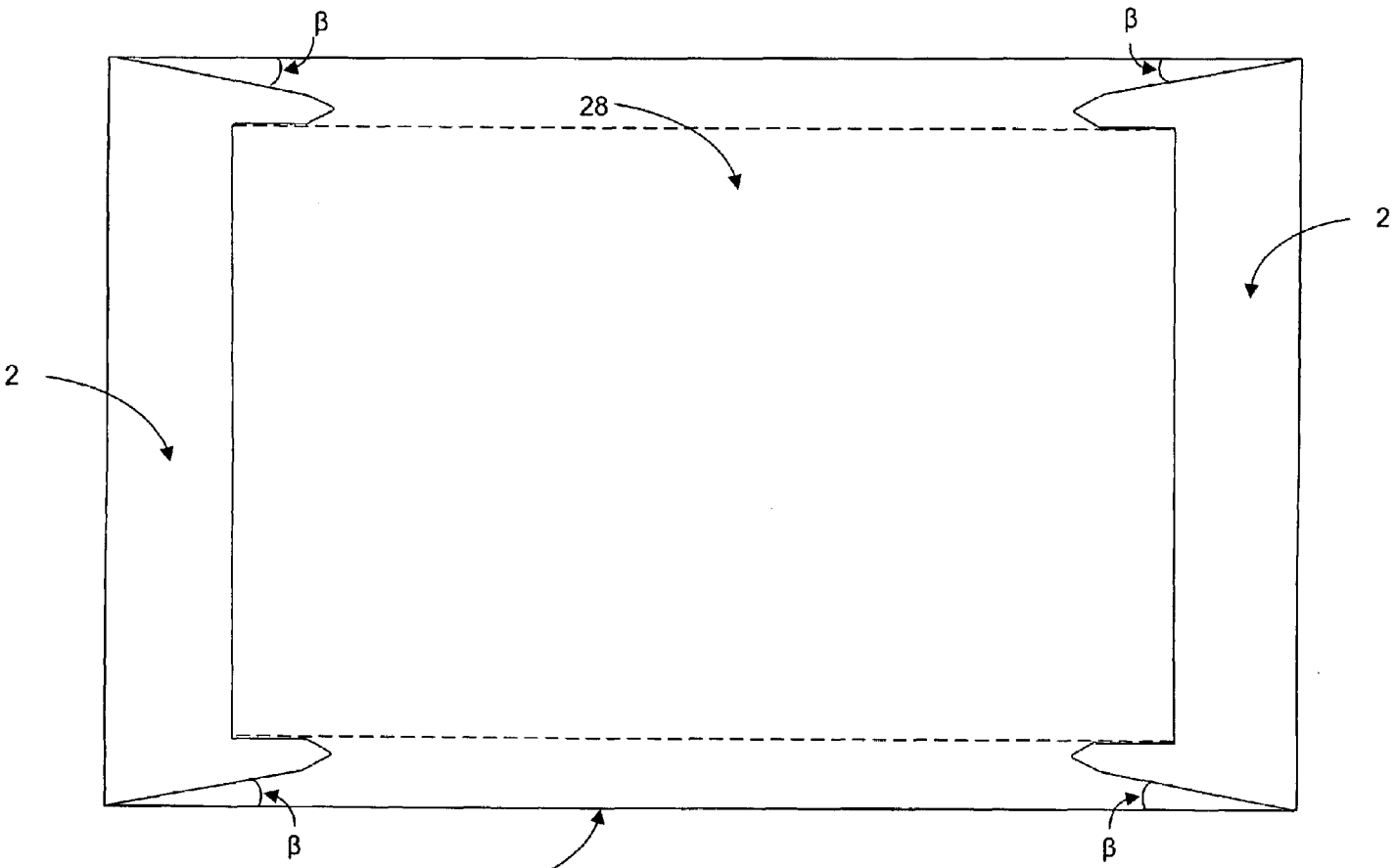
FIG. 10B is a cross-sectional side view of the shock sensitive article supported by a pair of spring system end caps within a shipping carton of FIG. 10A, showing taper of the end caps.

As illustrated in FIG. 10B, an end cap 2 formed using a mold having a draft will include an outer wall 12 having a taper β ranging from two to five degrees or more (for example where the surface of the mold is textured, the draft can be greater). FIGS. 2A–2F and 5A–5H, for example, illustrate end caps 2 having a slight taper that can result from a mold having a draft. The width of the end cap 2 measured from upper edges of the outer walls 12 is narrower than the width of the end cap 2 measured from the lower edges of the outer walls 12. Where a fragile article 28 having end caps 2 at opposing ends of the fragile article 28 is placed in a shipping carton 30, for example such that the platform 4 of each end cap 2 is vertically positioned, a gap can exist between the bottom inner surfaces of the shipping carton 30 and the outer wall 12 of each end cap 2. The gap increases in width along the taper of the outer walls 12. When a shipping carton 30 is dropped from a height, or otherwise impacted, the inertia of the fragile article 28 connected with the end caps 2 causes the fragile article 28 to continue accelerating until the outer wall 12, under force from the weight of the fragile article 28, collapses the gap and contacts the bottom inner surface of the shipping carton 30. This continued acceleration of the fragile article 28 can cause undesired stress on the spring system 14 and the fragile article 28, as the speed and tension experienced by the spring systems 14 are in many circumstances designed to be carefully controlled.

Figure 11A:
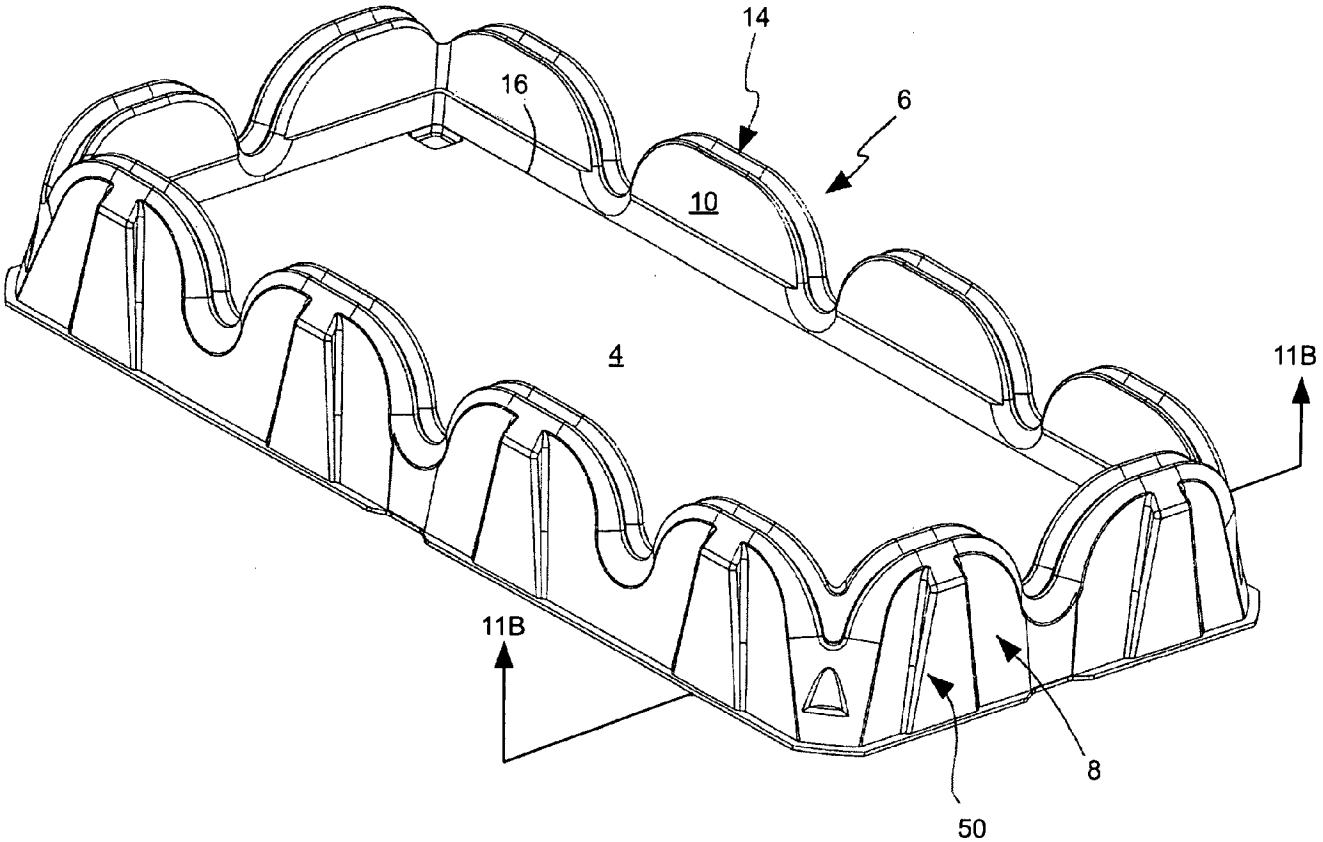
FIG. 11A is a perspective view of a spring system end cap having a rib formed on an outer wall at each spring system in accordance with one embodiment of the present invention.
Figure 11B:
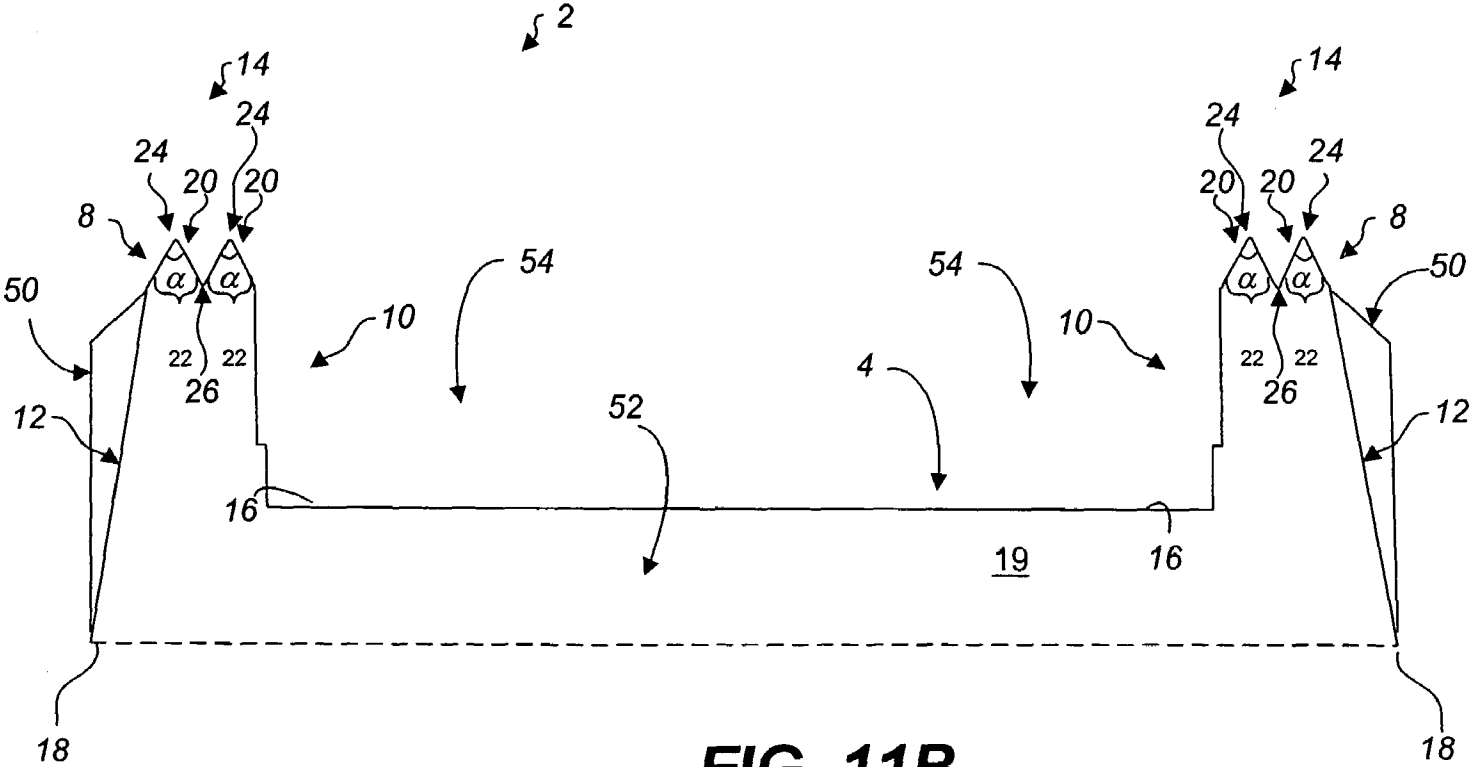
FIG. 11B is a cross-sectional view of the spring system end cap of FIG. 11A.

FIGS. 11A and 11B illustrate a rectangular end cap 2 including at least one rib 50 formed on an outer wall 12 of an end cap 2 in accordance with one embodiment of the present invention. Each rib 50 can be formed such that the rib 50 includes a minimum amount of taper associated with an injection molding process. By having a minimum taper, the rib 50 can be positioned substantially flush with an inner surface of a shipping carton 30 when a fragile article 28 is packaged. Where the shipping carton 30 is dropped, or otherwise impacted, the rib 50 can be immediately engaged by the decelerated wall of the shipping carton 30, transferring a substantial portion of the force of the impact to the spring system 14. In addition to engaging the spring system 14, the rib can be designed to absorb some of the shock force by at least partially collapsing as the spring system 14 is engaged or prior to engaging the spring system 14. The rib 50 thus can reduce the acceleration experienced by the fragile article 28 when the shipping carton 30 rapidly decelerates and the gap between the end cap 2 and the shipping carton 30 is collapsed.

Each rib 50 can be centered along the length of each spring system 14 so that the shock force is transferred roughly about an axis from the lower edge of the outer wall 12 to a peak of the arcuate shape of the spring system 14. In one embodiment, the rib 50 can have an overall trapezoidal shape such that the width of the rib 50 at the lower edge is wider than the width of the rib 50 at the peak of the arcuate shape. The divergence angle formed between two non-parallel sides of the trapezoid shaped rib 50 can be defined by the requirements of the manufacturing process, as described below.

The shape of the rib 50 is limited by the manufacturing process and can be driven by a number of variables. As previously described, a draft can be included in a mold used in injection molding to improve manufacturing by easing the ejection or removal of the end cap 2 from the mold. Reducing the ease of removal of the end cap 2 from the mold can be minimized while improving end cap 2 performance by including ribs 50 that require only a fraction of the surface area of the mold to have only a slight draft, or no draft. The ease of ejection or removal of the end cap 2 can be balanced against the advantages of the size and shape of the rib 50 until a desired result is produced. For example, removal of an end cap 2 from a mold can be dependent on a depth of a feature; therefore, each rib 50 can be wider at a lower edge (at a shallow portion of the mold) and narrower at the upper edge (at a deeper portion of the mold), giving each rib 50 a trapezoidal shape. However, a rib 50 need not have a trapezoidal shape. For example, the rib 50 could have a rectangular shape. Likewise, the width of the rib 50 is similarly dependent on manufacturing requirements and desired results. Further, the shape of each rib 50 can be significantly different if a manufacturer chooses to include a small taper with each rib 50 (for example less than a taper of an outer wall 12, but greater than zero). Still further, the rib 50 can begin to protrude from the outer wall 12 at the lower edge of the outer wall 12, or the rib 50 can begin to protrude from the outer wall 12 between the upper and lower edge of the outer wall 12. Likewise, the rib 50 can extend to the upper edge of the outer wall 12, or the rib 50 can terminate between the upper and lower edge of the outer wall 12. Further, the shape of the rib 50 can depend on the shape of the end cap 2 (e.g. where the end cap can be shaped as shown in FIG. 5J–9B). One of ordinary skill in the art can appreciate the myriad different geometries with which a rib 50 can be formed depending on the needs of the manufacturer and the desired rigidity of the end cap 2.

As described above, the spring system end caps 2 protect fragile article(s) within a shipping carton 30 by absorbing forces that are applied to the shipping carton 30. Such forces can result, for example, from the shipping carton 30 being dropped or knocked over, or from further shipping cartons being placed on top of the first shipping carton 30 or pushed against the first shipping carton 30. Damage can nevertheless occur where the forces applied to the shipping carton 30 are extremely large, such that the rigidity and stiffness of the spring system(s) 14 is overcome and the spring system(s) 14 collapses so that the platform 4 strikes the outer wall 12 and the outer wall 12 strikes the inner surface of the shipping carton 30.

Where the platform 4 absorbs the force of an impact and the applied forces overcome the flexibility of the structure, the platform 4 can be crushed or deformed at unpredictable points. A result of unpredictable crush points is that the fragile article(s) can be damaged. A further result of such unpredictable crush points is that the integrity of the end cap 2 can be ruined, and thus the fragile article(s) can be damaged by the force causing the unpredicted crush point and/or later applied forces. Additionally, such unpredicted crush points are unsightly and can cause a customer unpacking the fragile article(s) to question whether the producer and/or shipper took proper care of the fragile article(s).

Figure 12A:
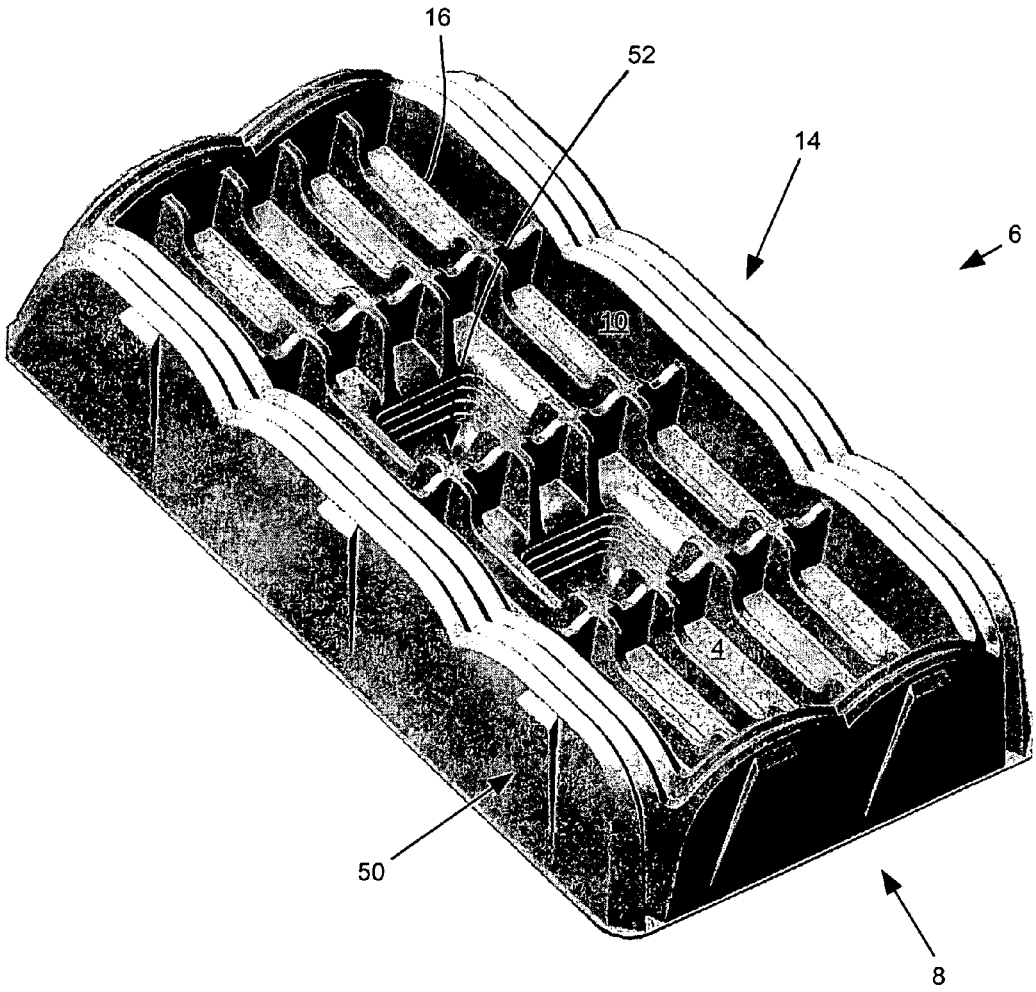
FIG. 12A is a perspective view of a spring system end cap having a rib formed on an outer wall at each spring system and two bulbous structures formed on the platform.

An end cap in accordance with one embodiment of the present invention, can include one or more bulbous features formed in a platform 4. FIG. 12A is a perspective view of an end cap 2 having two bulbous 52 features symmetrically positioned near the center of the platform 4. The end cap 2 shown in FIG. 12A–12C includes shallow walls, or reinforcing structures 54 molded into the end cap 2 for reinforcing the platform. An end cap 2 in accordance with embodiments of the present invention can include more or fewer reinforcing structures 54 having similar or different geometries (or no reinforcing structures, as shown in FIG. 2–11B). When an extreme shock force is applied to the end cap 2, for example along the top and bottom of the end cap 2, one or more spring systems 14 can collapse, causing the platform 4 to collide with the outer wall 12 of the end cap 2 and the outer wall 12 to collide with the inner surface of the shipping carton 30. The extreme shock force can place severe stress on the platform 4. The bulbous feature(s) 52 provide a collapsible structure for absorbing the additional stress placed on the platform 4. As the extreme shock force builds stress on the platform 4, the bulbous feature(s) 52 fail and collapse in a predictable manner.

Because the platform 4 fails in a predictable manner, along predefined "crush zones", fragile article(s) can be packed so as to avoid damage during a crush event. The bulbous features 52 of the present invention provide for predicted deformation paths thereby reducing and possibly preventing random crush zones or points from occurring within the platform 4. Such predicted deformation paths provide several advantages. For example, end caps 2 that incorporate one or more bulbous features 52 can be used to ship fragile article(s) having a broad weight range. The predicted deformation paths reduce permanent deformation of the end caps 2 and provide for improved overall cushioning, thereby increasing protection of fragile article(s) and significantly reducing damage that can occur to the fragile article(s). The bulbous features 52 also improve the cosmetic appearance of the end caps 2 because a majority of crushing occurs at the bulbous feature 52, preventing random unsightly crush points from occurring throughout the article.

Figure 12B:
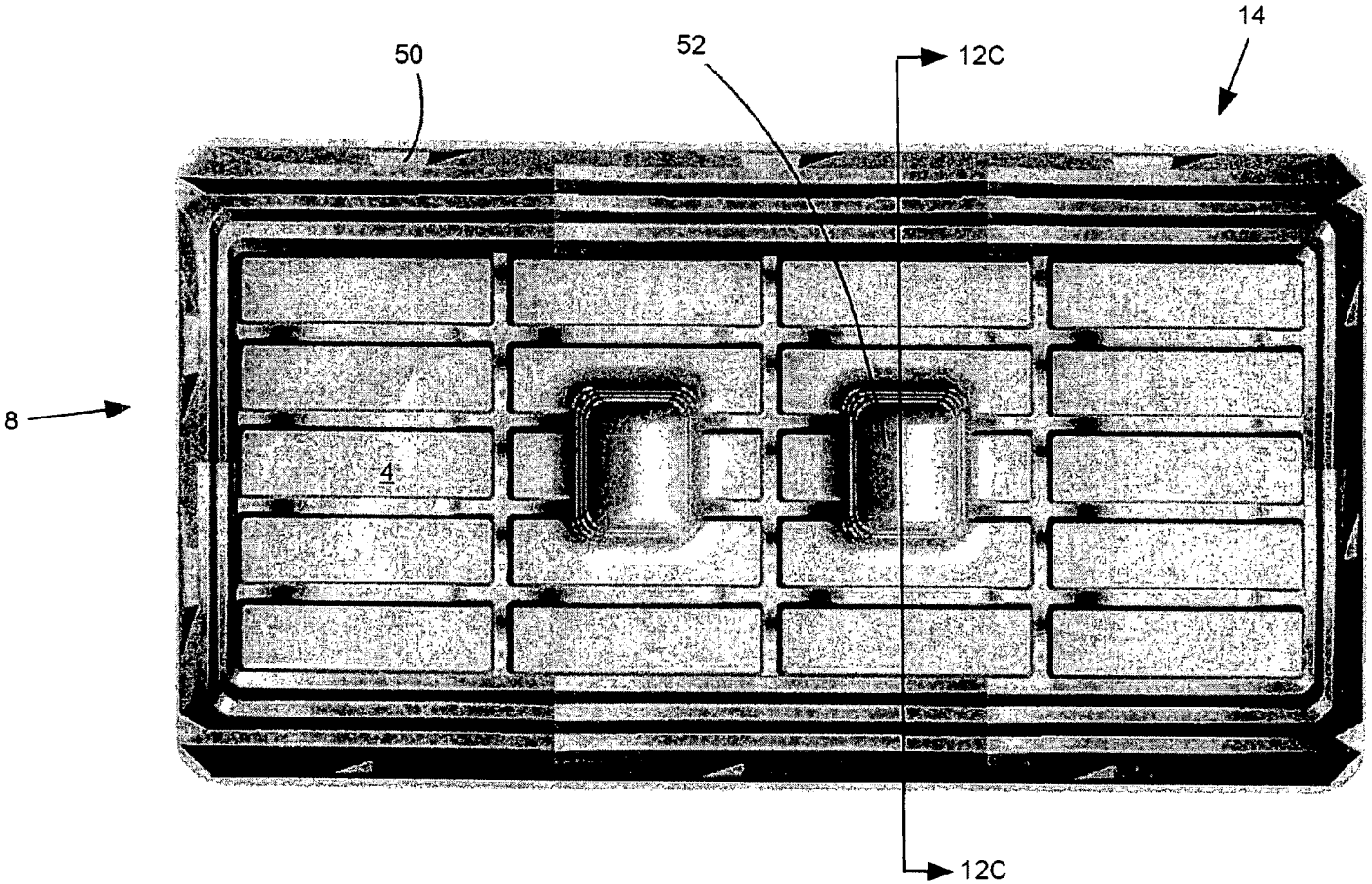
FIG. 12B is a top-down view of the spring system end cap of FIG. 12A.

As illustrated in FIG. 12B, two bulbous features 52 can be located on the platform 4 so that the features 52 are approximately centered along the Y axis and symmetrically spaced about a center of the X axis. As can be appreciated, the platform 4 can buckle away from the periphery of the platform 4 because the periphery is reinforced by the inner and outer walls of the spring systems 14. The bulbous features 52 can be located near failure points across the platform 4 so as to predictably collapse and crush when extreme shock forces are applied to the end cap 2. In other embodiments, the platform can include a single bulbous feature 52 positioned at, or near, the center of the platform 4. In other embodiments, the platform 4 can include more than two bulbous features 52. In still other embodiments, the bulbous features 52 can be positioned off-center and/or non-symmetrically. For example, where a fragile article(s) to be packaged includes its most delicate components distributed in one portion of the end cap 2, the bulbous features can be placed to collapse away from the delicate components. One of ordinary skill in the art can appreciate the different strategies for controlling failure of the end cap 2.

Figure 12C:
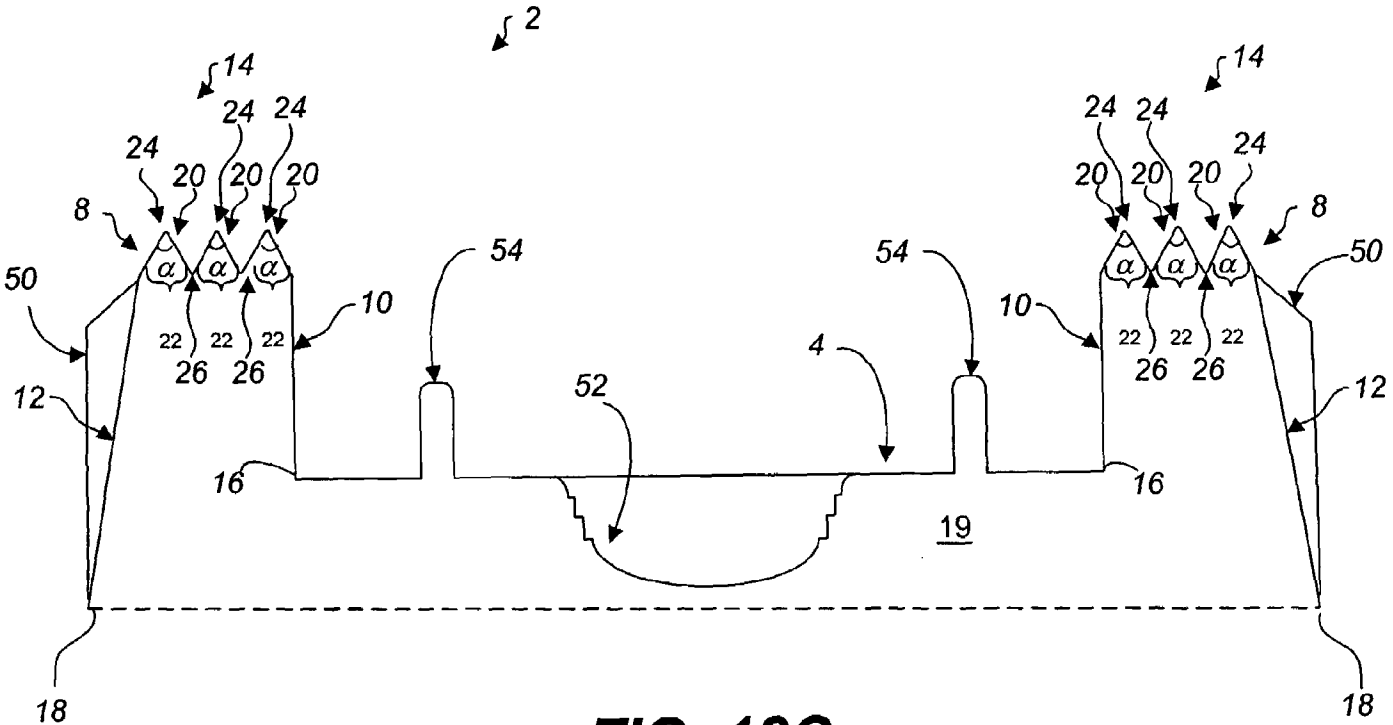
FIG. 12C is a cross-sectional view of the spring system end cap of FIG. 12A through a bulbous structure.

Each bulbous feature 52 can be roughly rectangular or square shaped, with rounded edges. In other embodiments, the bulbous feature 52 can have other shapes, for example hexagonal. As can be seen in FIG. 11C, each bulbous feature 52 can have a tiered cross-section and a rounded bottom. As mentioned, the bulbous feature 52 collapses (for example with the rounded bottom bulging out and the sidewalls of the bulbous feature collapsing) when extreme shock forces cause the platform to strike the outer walls 12 causing additionally stress to be placed on the platform 4. The bulbous feature 52 need not necessarily include tiered sidewalls; however, one or more tiers can be included to control stiffness of the sidewalls. As shown in FIG. 12C, the bulbous feature 52 is shaped such that rounded bottom nearly meets a plane formed by the lower edge of the outer wall 12. However, in other embodiments the bulbous feature 52 can be shallower or deeper, as desired.

The foregoing description of preferred embodiments of the present invention has been provided for the purposes of illustration and description. It is not intended to be exhaustive or to limit the invention to the precise forms disclosed. Many modifications and variations will be apparent to one of ordinary skill in the relevant arts. For example, the end caps described herein can be used to ship any kind of article, whether it is fragile or not. Further, the name "end cap" does necessarily mean the end caps of the present invention hold the "ends" of the article. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalence.

What is claimed is:

1. A unitary spring system end cap for supporting an article, comprising:

a platform adapted to support at least a portion of the article, the platform being generally arranged in a first plane; and a sidewall structure including:

an inner wall connected with said platform, an outer wall forming an acute angle relative to a second plane perpendicular to said first plane, a spring system connected between said inner wall and said outer wall, and a rib protruding from said outer wall a distance that varies along a gap between the second plane and the outer wall such that a contact surface of the rib is generally parallel to the second plane and generally perpendicular to the first plane; and wherein the spring system is operably connected with the rib.

2. The unitary spring system end cap as recited in claim 1, wherein when the rib is impacted, the rib can engage the spring system.

3. The unitary spring system end cap as recited in claim 1, wherein said sidewall structure includes a plurality of said spring systems formed end to end, wherein each spring system is connected with said outer wall along a ridge forming a plurality of arcs connected end to end along the length of said sidewall structure.

4. A system for supporting an article, comprising:

a first end cap including:

a first platform portion adapted to support a first portion of the article, the first platform being generally arranged in a first plane;

a sidewall structure having:

a first inner wall connected with said first platform portion and surrounding the periphery of said first platform portion;

a first outer wall forming an acute angle relative to an axis perpendicular to said first plane and surrounding the periphery of said first inner wall;

at least one first spring system connected between said first inner wall and said first outer wall, each of said at least one first spring system including at least one bellows; and at least one first rib protruding from said first outer wall; and a second end cap including:

a second platform portion adapted to support a second portion of the article, the second platform being generally arranged in a second plane;

a sidewall structure having:

a second inner wall connected with said second platform portion and surrounding the periphery of said second platform portion;

a second outer wall forming an acute angle relative to an axis perpendicular to said second plane and surrounding the periphery of said second inner wall;

at least one second spring system connected between said second inner wall and said second outer wall, each of said at least one second spring system including at least one bellows; and at least one second rib protruding from said second outer wall; and wherein the at least one first rib and the at least one second rib have a face substantially perpendicular to one of the first and second planes.

5. A system, for supporting a laptop computer, comprising:

a first end cap including:

a first platform portion adapted to support a first portion of the laptop computer, the first platform being generally arranged in a first plane;

a sidewall structure having:

a first inner wall connected with said first platform portion and surrounding the periphery of said first platform portion;

a first outer wall forming an acute angle relative to an axis perpendicular to said first plane and surrounding the periphery of said first inner wall;

at least one first spring system connected between said first inner wall and said first outer wall, each of said at least one first spring system including at least one bellows; and at least one first rib protruding from said first outer wall; and a second end cap including:

a second platform portion adapted to support a second portion of the laptop computer, the second platform being generally arranged in a second plane;

wherein the at least one first rib and the at least one second rib have a face substantially perpendicular to one of the first and second planes.

* * * * *